US011599046B2

(12) United States Patent
Furusawa

(10) Patent No.: US 11,599,046 B2
(45) Date of Patent: Mar. 7, 2023

(54) IMAGE FORMATION APPARATUS

(71) Applicant: Oki Electric Industry Co., Ltd., Tokyo (JP)

(72) Inventor: Yasunori Furusawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/544,284

(22) Filed: Dec. 7, 2021

(65) Prior Publication Data

US 2022/0260942 A1 Aug. 18, 2022

(30) Foreign Application Priority Data

Feb. 18, 2021 (JP) ..... JP2021-024249

(51) Int. Cl.
*G03G 15/20* (2006.01)
*G03G 15/08* (2006.01)

(52) U.S. Cl.
CPC ..... *G03G 15/2017* (2013.01); *G03G 15/0808* (2013.01)

(58) Field of Classification Search
CPC ..... G03G 15/0808; G03G 15/2017
See application file for complete search history.

(56) References Cited

U.S. PATENT DOCUMENTS

| | | | | |
|---|---|---|---|---|
| 9,360,834 | B1 * | 6/2016 | Payne | G03G 21/1867 |
| 2014/0169824 | A1 * | 6/2014 | Seto | G03G 21/1652 399/90 |
| 2017/0168447 | A1 * | 6/2017 | Carpenter | G03G 21/1867 |
| 2017/0205762 | A1 * | 7/2017 | Amann | G03G 15/80 |
| 2021/0278801 | A1 * | 9/2021 | Ishii | G03G 15/0863 |

FOREIGN PATENT DOCUMENTS

JP 2019-191419 A 10/2019

* cited by examiner

*Primary Examiner* — Sevan A Aydin
(74) *Attorney, Agent, or Firm* — Metrolex IP Law Group, PLLC

(57) ABSTRACT

An image formation apparatus according to an embodiment may include: a fixation unit detachable from a main body of the image formation apparatus; a movable guide member holding a first connector and movably provided to the main body; a second connector provided to the fixation unit; and an engagement portion provided around the second connector. Upon mounting the detachable unit to the main body, the engagement portion contacts the movable guide member to move the movable guide member to position the first connector held by the movable guide member to a fittable range where the first and second connectors can be fitted to each other. Upon fitting the first and second connectors to each other, the first connector contacts the second connector to move the movable guide member holding the first connector to align the first connector to the second connector.

12 Claims, 18 Drawing Sheets

IMAGE FORMATION APPARATUS

CROSS REFERENCE TO RELATED APPLICATIONS

This application claims priority based on 35 USC 119 from prior Japanese Patent Application No. 2021-24249 filed on Feb. 18, 2021, entitled "IMAGE FORMATION APPARATUS", the entire contents of which are incorporated herein by reference.

BACKGROUND

The disclosure may relate to an image formation apparatus equipped with a detachable unit including a connector, for example, a fixation device.

In a related art, in order to avoid poor contact between an electrode of a first connector provided at a unit and a contact terminal of a second connector provided at a member upon mounting the unit to the member, there is a configuration in which the first connector is mounted in a predetermined position in the second connector by inserting the first connector in a direction inclined to a predetermined direction while contacting an inclined surface of the second connector, and then rotating the first connector with the contact terminal being in contact with the electrode. (See, for example, Patent Document 1).

Patent Document 1: Japanese Patent Application Publication No. 2019-191419 (see pages 8 and 9, FIG. 6)

SUMMARY

However, there may be cases where the connectors do not fit with each other, and thus there may be a problem in improving the fitting performance.

An aspect of the disclosure may be an image formation apparatus that may include: a detachable unit that is attachable to and detachable from a main body of the image formation apparatus; a movable guide member holding a first connector and movably provided to one of the detachable unit and the main body of the image formation apparatus; a second connector provided to the other of the detachable unit and the main body of the image formation apparatus; and an engagement portion provided around the second connector. Upon mounting the detachable unit to the main body of the image formation apparatus, the engagement portion contacts the movable guide member to move the movable guide member with respect to the one of the detachable unit and the main body of the image formation apparatus so as to position the first connector held by the movable guide member to a fittable range where the first connector and the second connector can be fitted to each other. Upon fitting the first connector and the second connector to each other, the first connector contacts the second connector to move the movable guide member holding the first connector with respect to the one of the detachable unit and the main body of the image formation apparatus so as to align the first connector to the second connector.

Another aspect of the disclosure may be an image formation apparatus that may include: a fixation unit that is attachable to and detachable from a main body of the image formation apparatus; a movable guide member holding a first connector and movably provided to the main body of the image formation apparatus; a second connector provided to the fixation unit; and an engagement portion provided around the second connector. Upon mounting the detachable unit to the main body of the image formation apparatus, the engagement portion contacts the movable guide member to move the movable guide member with respect to the main body of the image formation apparatus to position the first connector held by the movable guide member to a fittable range where the first connector and the second connector can be fitted to each other. Upon fitting the first connector and the second connector to each other, the first connector contacts the second connector to move the movable guide member holding the first connector with respect to the main body of the image formation apparatus so as to align the first connector to the second connector.

According to the aspect(s) described above, the first connector and the second connector can be allowed to be misaligned with each other upon fitting the first connector and the second connector with each other, and an allowable range of misalignment of the detachable unit upon mounting the detachable unit to the main body of the image formation apparatus can be expanded.

BRIEF DESCRIPTION OF DRAWINGS

FIGS. 8A and 8B are diagrams of explanatory views for schematically explaining a relationship between the fixation device and a main body of the image formation apparatus, wherein FIG. 8A illustrates a state in which the fixation device is removed upwardly from the main body of the image formation apparatus, and FIG. 8B illustrates a state in which the fixation device is mounted to the main body of the image formation apparatus;

FIGS. 28A and 28B are diagrams illustrating a main configuration of an image formation apparatus according to a second embodiment, wherein FIG. 28A illustrates a state in which a fixation device is removed upwardly from a main body of the image formation apparatus, and FIG. 28B illustrates a state in which the fixation device is mounted to the main body of the image formation apparatus;

FIGS. 29A and 29B are diagrams illustrating a main configuration of an image formation apparatus according to a third embodiment, wherein FIG. 29A illustrates a state in which a transfer device is removed upwardly from a main body of the image formation apparatus, and FIG. 29B illustrates a state in which the transfer device is mounted to the main body of the image formation apparatus; and FIGS. 30A and 30B are diagrams illustrating a main configuration of an image formation apparatus according to a fourth embodiment, wherein FIG. 30A illustrates a state in which a first option tray and a second option tray are removed downwardly from a main body of the image formation apparatus, and FIG. 30B illustrates a state in which the first option tray and the second option tray are mounted to the main body of the image formation apparatus.

DETAILED DESCRIPTION

Figure 1:
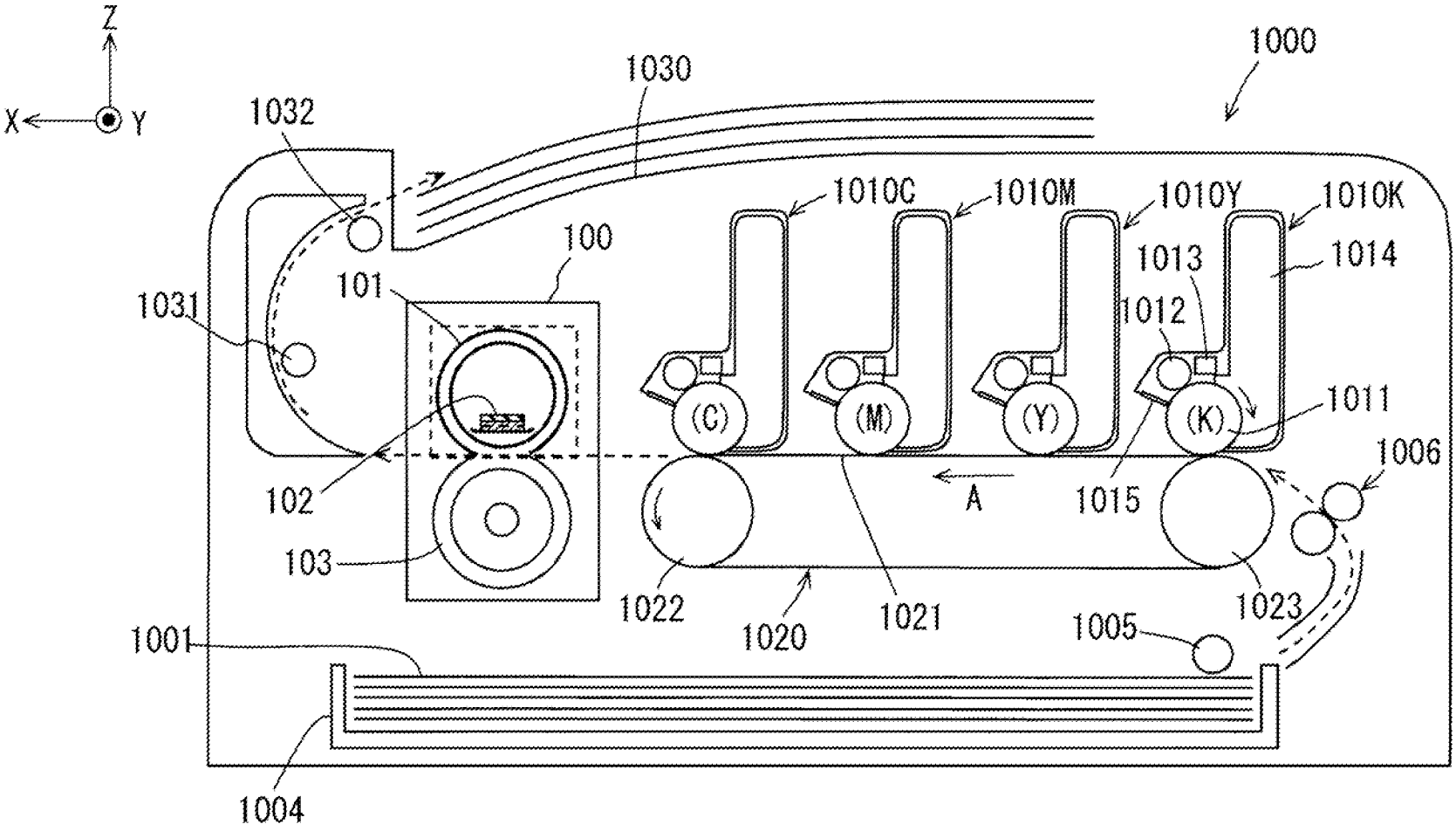
FIG. 1 is a diagram illustrating a schematic view of a main configuration of an image formation apparatus according to a first embodiment.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a diagram illustrating a schematic configuration of a main configuration of an image formation apparatus 1000 according to a first embodiment.

The image formation apparatus 1000 illustrated in FIG. 1 has a configuration as, for example, a color electrophotographic printer. The image formation apparatus 1000 includes therein: a paper feed cassette 1004 storing therein recording paper 1001 as recording media and mounted inside the image formation apparatus; a paper feed roller 1005 configured to take out the recording paper 1001 from the paper feed cassette 1004; and a resist roller 1006 configured to feed the recording paper 1001 to an image formation section at a certain timing. The image formation apparatus 1000 includes therein, as the image formation section which is configure to form developer images, a development device 1010K configured to form a black (K) toner image, a development device 1010Y configured to form a yellow (Y) toner image, a development device 1010M configured to form a magenta (M) toner image, and a development device 1010C configured to form a cyan (C) toner image, in such a manner that the development devices 1010K, 1010Y, 1010M, and 1010C are arranged in that order from an upstream side along a conveyance path of the recording paper 1001. Note that the development devices 1010K, 1010Y, 1010M, and 1010C may be simply referred to as development devices 1010 when there is no need to particularly distinguish them. These development devices 1010 have the same configurations except for the colors of the toners used therein.

For example, as in the development device 1010K that uses black (K) toner illustrated in FIG. 1, each development device 1010 includes: a photosensitive drum 1011 serving as an electrostatic latent image carrier; a charging device 1012 configured to supply an electric charge to a surface of the photosensitive drum 1011, and an exposure device 1013 configured to selectively irradiate light based on image data onto the surface of the photosensitive drum 1011 so as to form an electrostatic latent image on the surface of the photosensitive drum 1011; a developer supply device 1014 configured to supply the toner described above to develop the electrostatic latent image on the photosensitive drum 1011 to form a toner image; and a cleaning device 1015 disposed in contact with the photosensitive drum 1011 and configured to remove the toner remaining on the surface of the photosensitive drum 1011, wherein the charging device 1012, the exposure device 1013, the developer supply device 1014, and the cleaning device 1015 are arranged around the photosensitive drum 1011 in that order from an upstream side in a rotational direction (see the arrow in FIG. 1) of the photosensitive drum 1011.

The image formation apparatus 1000 also includes therein a belt-type transfer device 1020 that includes an endless transfer belt 1021 configured to convey the recording paper 1001 to sequentially transfer the toner images formed by the respective development devices onto the conveyed recording paper 1001, a drive roller 1022 configured to be rotated by a driver (not illustrated) to drive the endless transfer belt 1021 in the direction of the arrow A, and a tension roller 1023 paired with the drive roller 1022 and configured to apply tension to the endless transfer belt 1021 to stretch the endless transfer belt 1021 between the drive roller 1022 and the tension roller 1023.

The image formation apparatus 1000 further includes therein a fixation device 100 configured to apply heat and pressure to the toner images formed on the recording paper 1001 to fix the toner images to the recording paper 1001, and conveyance rollers 1031 and 1032 configured to convey the recording paper 1001 that has passed through the fixation device 100 and discharge the recording paper 1001 having the toner images fixed thereon to a discharged paper stacker 1030 on which the discharged recording paper are to be stacked. The fixation device 100 is detachably mounted to the main body of the image formation apparatus 1000. The configuration and the operation of mounting the fixation device 100 to the main body of the image formation apparatus 1000 are described in detail later.

Note that the X, Y, and Z axes illustrated in FIG. 1 are defined in that the X axis is parallel to the conveyance direction in which the recording paper 1001 passes through the image formation section, the Y axis is parallel to the rotational axis of the photosensitive drum 1011, and the Z axis is parallel to a direction orthogonal to both the X axis and the Y axis. The X, Y, and Z axes are also illustrated in the other figures described below, indicating the same directions as in FIG. 1. That is, the X, Y, and Z axes in each figure indicate the directions of arrangement of the image formation apparatus 1000 illustrated in FIG. 1. Note that the Z axis is oriented in a substantially vertical direction.

Next, an outline of printing operation of the image formation apparatus 1000 having the above configuration is described with reference to FIG. 1. Note that the dotted arrows in FIG. 1 indicate the conveyance direction in which the recording paper 1001 is being conveyed.

When an operator performs a well-known operation(s) to start image formation in the state where the power is supplied to the image formation apparatus 1000, the image formation apparatus 1000 takes out the recording paper 1001 stored in the paper feed cassette 1004 from the paper feed cassette 1004 by the paper feed roller 1005 to feed the recording paper 1001 to the conveyance path, corrects the skew by the resist roller 1006, and then conveys the recording paper 1001 to the image formation section including the four development devices 1010 and the transfer device 1020 at a predetermined timing.

In each of the development devices 1001 in the image formation section, as the photosensitive drum 1011 rotates in the rotation direction thereof (the direction of the arrow in FIG. 1), the charging device 1012, to which a voltage is applied by a power supply device (not illustrated), charges the surface of the photosensitive drum 1011. Then, when the charged surface of the photosensitive drum 1011 reaches the vicinity of the exposure device 1013, the exposure device 1013 emits lights corresponding to the image information to form an electrostatic latent image on the charged surface of the photosensitive drum 1011. The developer supply device 1014 develops the electrostatic latent image on the surface of the photosensitive drum 1011 with the toner thereof so as to form the toner image of the corresponding color on the surface of the photosensitive drum 1011.

The recording paper 1001 conveyed to the image formation section is adsorbed to the endless transfer belt 1021 and conveyed by the endless transfer belt 1021 in the direction of the arrow A. While being conveyed on the endless transfer belt 1021, the recording paper 1001 is sequentially nipped between the endless transfer belt 1021 and the photosensitive drums 1011 of the respective development devices 1010 rotating in the arrow direction illustrated in FIG. 1. In the sequential nipping process, the toner images of black (K), yellow (Y), magenta (M), and cyan (C) colors formed on the photosensitive drums 1011 are sequentially transferred to the recording paper 1001 at predetermined timings in a superimposed manner so that a color image (a multi-color image) composed of the toner images of the respective colors is formed on the recording paper 1001. After transferring of the toner image from each photosensitive drum 1011, residual toner remaining on the photosensitive drum 1011 is scraped off and cleaned by the cleaning device 1015 and the photosensitive drum 1011 is charged for the next toner image formation.

Then, the recording paper 1001 on which the multi-color image composed of the respective color toner images is formed is conveyed to the fixation device 100. Then, the fixation device 100 applies pressure and heat to the multi-color image composed of the toner images on the recording paper 1001 so as to melt the toner images to fix the color image onto the recording paper 1001. The recording paper 1001 is then discharged by the conveyance rollers 1031 and 1032 to the discharged paper stacker 1030, so that the printing operation is completed.

Note that, in order to obtain a heat amount sufficient to heat the recording paper 1001 in the fixation device 100, a controller (not illustrated) controls a current applied to the heater 102 to heat a resistance heating element of the heater 102 so as to heat the heating roller 101. The pressure roller 103, which is provided in pressure contact with the heating roller 101, is powered by a drive system (not illustrated) to rotate. This rotation (the driving force) of the pressure roller 103 is transmitted to the heating roller 101, which also rotates the heating roller 101. The recording paper 1001 reached to the fixation device 100 is heated and pressurized in the nip section between the pressure roller 103 and the heating roller 101, so that the toner images on the upper surface of the recording paper 1001 is fixed to the upper surface.

Next, a mounting mechanism of the fixation device 100 which is detachably mounted to the main body of the image formation apparatus 1000 is described. Note that a part of the image formation apparatus 1000 excluding the components thereof such as the fixation device 100 and the like may be referred to as the main body of the image formation apparatus 1000.

Figure 2:
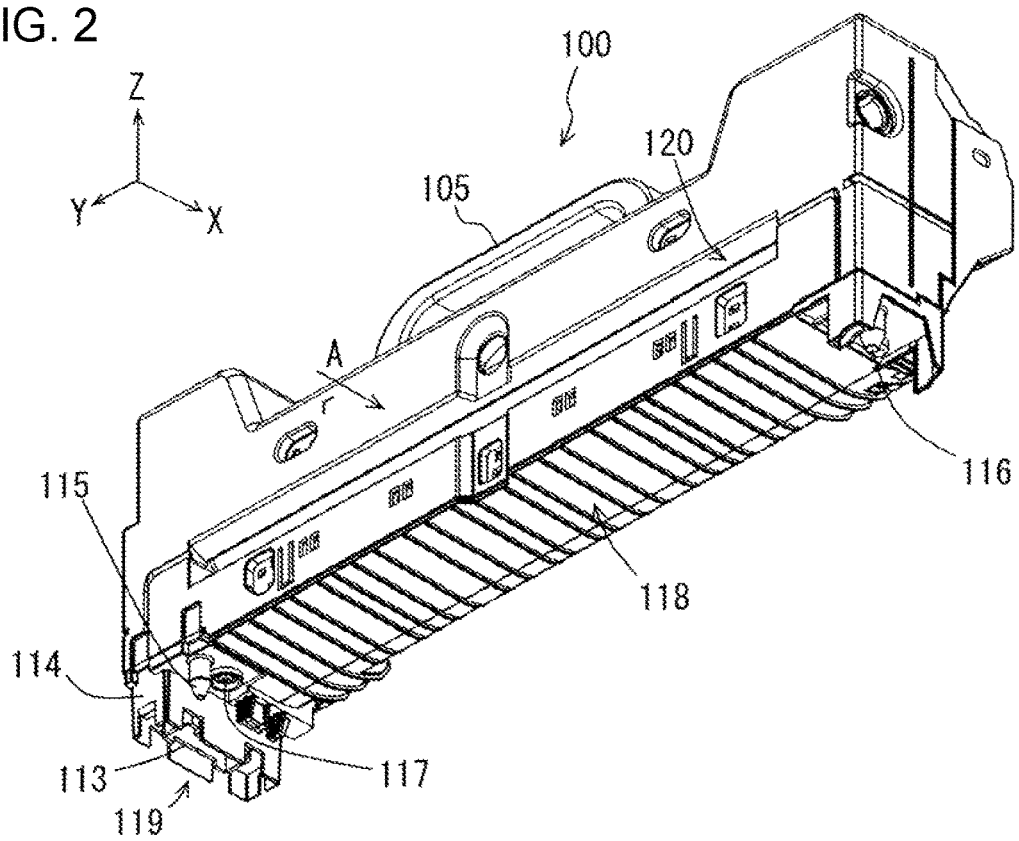
FIG. 2 is a diagram illustrating an external perspective view of a fixation device according to a first embodiment as viewed from diagonally below.
Figure 3:
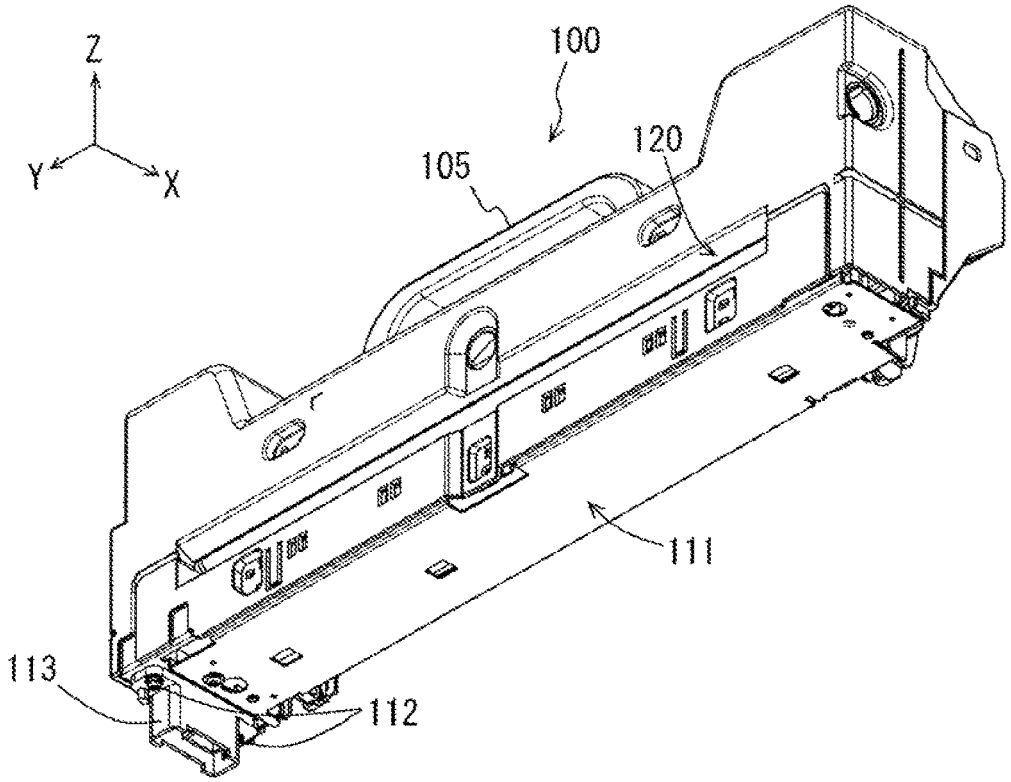
FIG. 3 is a diagram illustrating an external perspective view of the fixation device illustrated in FIG. 2 with a guide plate arranged at a lower part of the fixation device removed.
Figure 4:
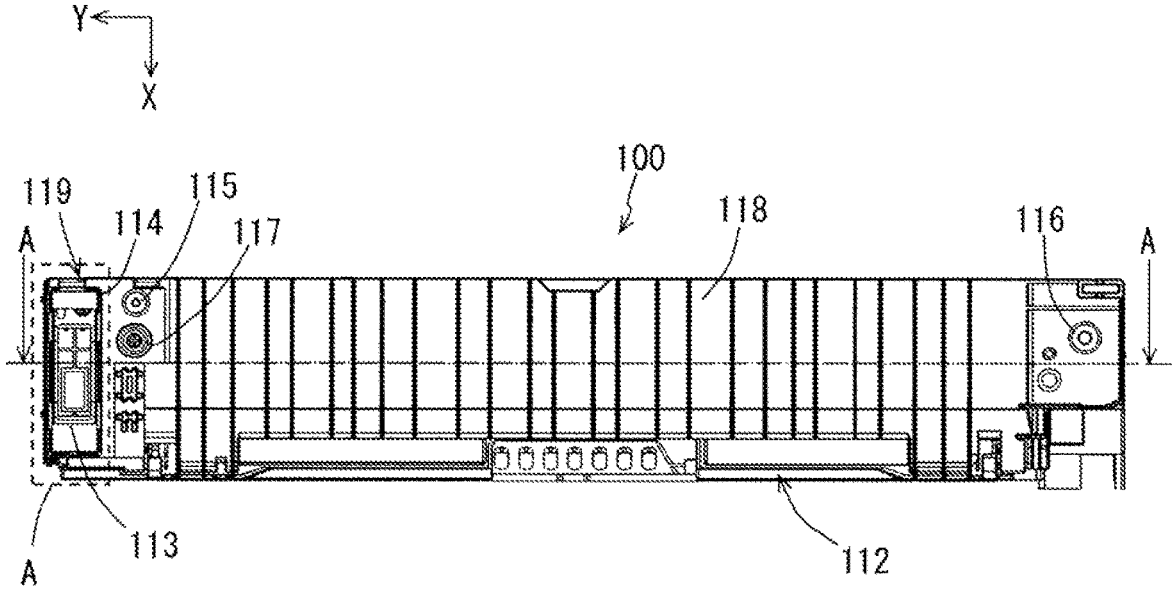
FIG. 4 is a diagram illustrating a bottom view of the fixation device illustrated in FIG. 2.
Figure 5:
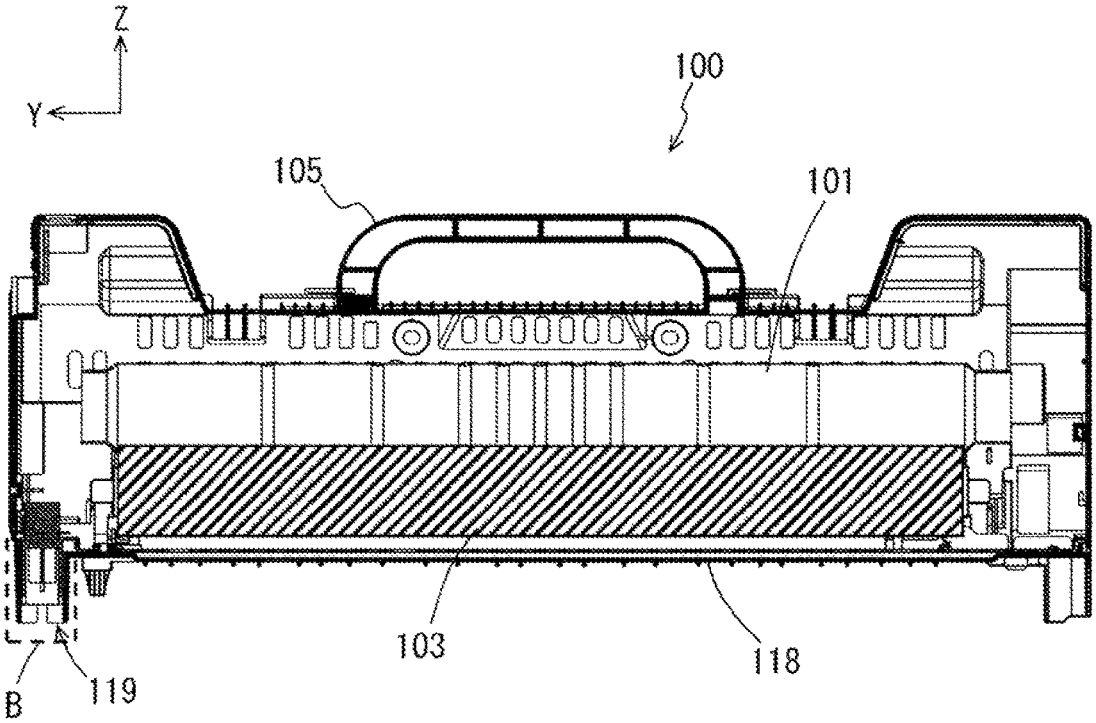
FIG. 5 is a diagram illustrating a sectional view of the fixation device, taken along the A-A line in FIG. 4.
Figure 6:
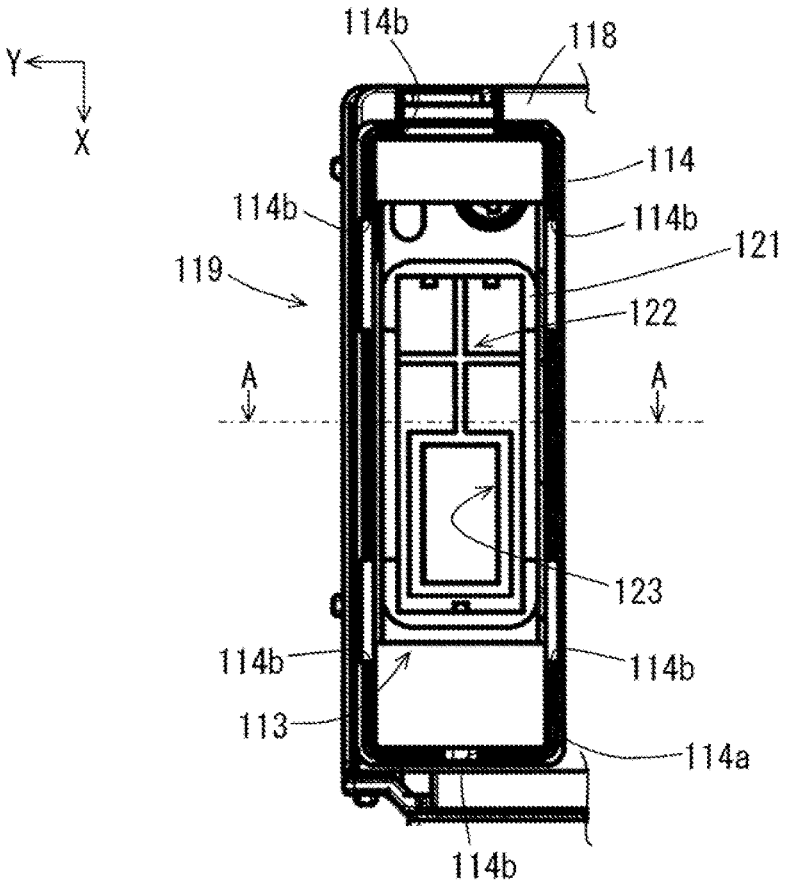
FIG. 6 is a diagram illustrating an enlarged partial view of a connector section provided to the fixation device enclosed by the dotted line A in FIG. 4.
Figure 7:
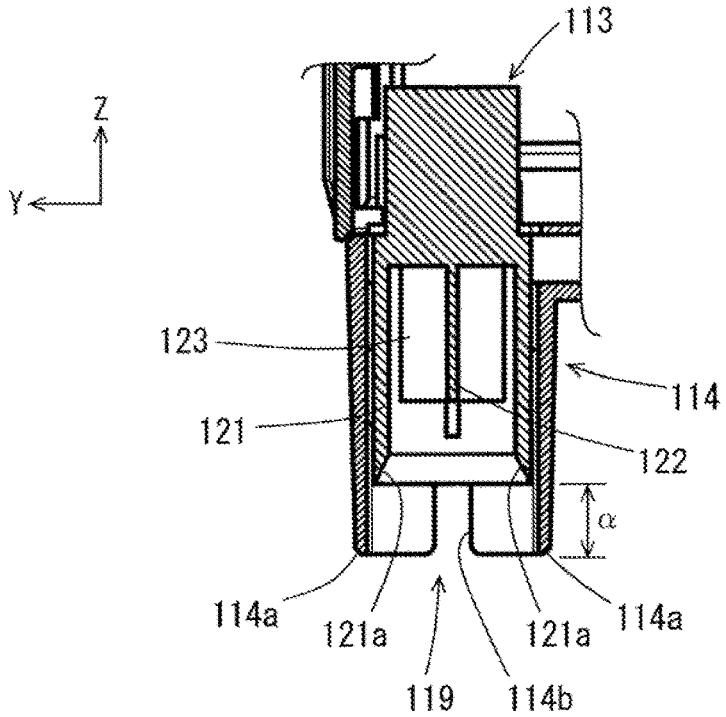
FIG. 7 is a diagram illustrating an enlarged partial view of the connector section of the fixation device enclosed by the dotted line B in FIG. 5.

FIG. 2 is an external perspective view of the fixation device 100 alone as viewed from diagonally below, FIG. 3 is an external perspective view of the fixation device 100 illustrated in FIG. 2 with a guide plate 118 arranged at a bottom portion being removed, FIG. 4 is a bottom view of the fixation device 100 illustrated in FIG. 2, FIG. 5 is a sectional view of the fixation device 100 taken along the A-A line in FIG. 4, FIG. 6 is an enlarged view of a connector section 119 provided to the fixation device (a fixation-device-side connector section 119) enclosed by the dotted line A in FIG. 4, and FIG. 7 is an enlarged view of the connector section 119 of the fixation device enclosed by the dotted line B in FIG. 5.

First, a configuration of a main part of the fixation device 100 is described with reference to FIGS. 2 to 7. As illustrated in FIG. 2, a paper entry port 120 is formed in the front of the fixation device 100 to receive the recording paper 1001 being conveyed along the arrow A direction. In the following description, the directions of up, down, left, right, front and rear of the fixation device 100 may be specified, as viewing the fixation device 100 from the front (in the direction of the arrow A in FIG. 2). In FIGS. 2 to 7, a connector 113 provided to the fixation device 100 (a fixation-device-side connector 113) is schematically illustrated with later-described first contact terminals 152 and second contact terminals 154 (see FIG. 25A) thereof being omitted.

At a bottom portion of the fixation device 100 serving as a detachable unit or a fixation unit, a base plate 111 (see FIG. 3) is provided. The connector 113 of the fixation device serving as a second connector is fixed by screws 112 to a left end portion of the base plate 111. The guide plate 118 is fixed by a screw(s) 117 to the base plate 111, wherein the guide plate 118 is formed with a connector guide portion 114 provided to the fixation device (a fixation-device-side connector guide portion 114), serving as an engagement portion, at the left end portion of the guide plate 118 and positioning posts 115 and 116 at the left and right end portions of the guide plate 118. The connector guide portion 114 of the fixation device is formed to surround the connector 113 of the fixation device, and the left and right positioning posts 115 and 116 protrude downwardly from the bottom portion of the fixation device 100.

FIG. 6 is a diagram illustrating an enlarged view of the connector section 119 of the fixation device illustrated in FIG. 4, and FIG. 7 is a diagram illustrating an enlarged view of the connector section 119 of the fixation device illustrated in FIG. 5. That is, FIG. 7 is a cross-sectional view taken along the A-A line in FIG. 6.

As illustrated in FIGS. 6 and 7, a lower half of the connector 113 of the fixation device is a fitting portion thereof to be fitted (mated) with a fitting portion of a connector 211 provided to the main body of the image formation apparatus (a main-body-side connector 211). An inner rib 121 of the connector 113 is formed to surround the fitting portion of the connector 113 and is protruded downwardly. Inside the annular-shaped inner rib 121, a cross shaped projection 122 that is formed in a cross shape and protrudes downwardly and an annular projection 123 that is formed in a square shape and protrudes downwardly are arranged in line in the front-rear direction (see FIG. 25A).

As illustrated in FIG. 7, the connector guide portion 114 surrounding the connector 113 of the fixation device extends downwardly further than the inner rib 121 of the connector 113 of the fixation device by a predetermined distance a. A lower end of the inner rib 121 is formed with a taper portion 121*a* serving as a fourth taper portion whose tapered surface is provided at an inner surface of the entire circumference of the inner rib 121 and is inclined inwardly. To the contrary, a lower end of the connector guide portion 114 of the fixation device is formed with a taper portion 114*a* serving as a third taper portion whose taper surface is provided at an outer surface of the entire circumference of the connector guide portion 114 of the fixation device except for six notches 114*b* and is inclined outwardly.

Figure 8A:
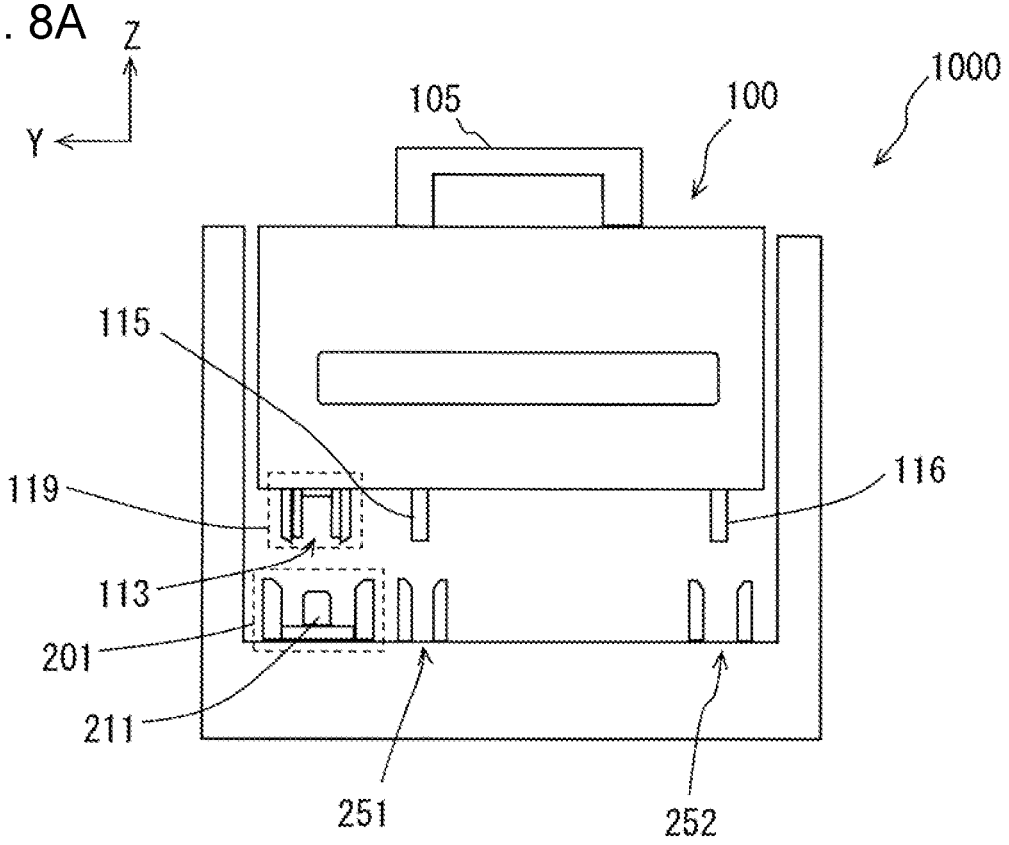
Figure 8B:
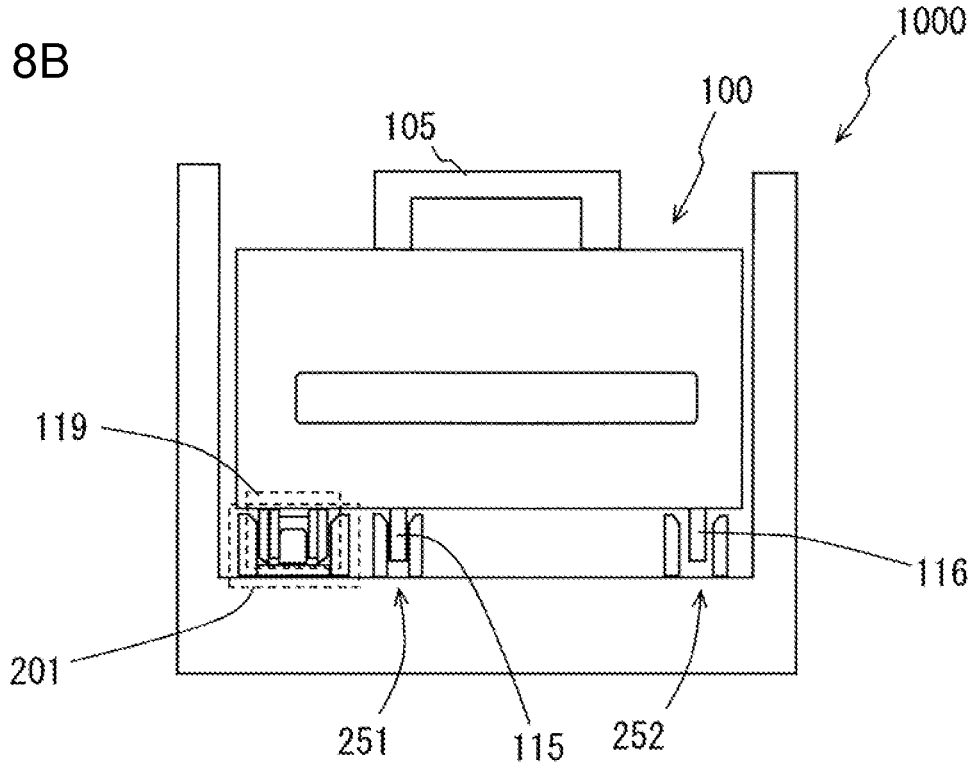

Here, a positional relationship between parts of the fixation device 100 and the main body of the image formation apparatus 1000 are described below. FIGS. 8A and 8B are schematic diagrams illustrating a positional relationship between the fixation device 100 and the main body of the image formation apparatus 1000, wherein FIG. 8A illustrates a state in which the fixation device 100 is removed upwardly from the main body of the image formation apparatus 1000, and FIG. 8B illustrates a state in which the fixation device 100 is mounted on the main body of the image formation apparatus 1000.

As illustrated in FIG. 8A, in the state where the fixation device 100 is opposed to be attached to the main body of the image formation apparatus 1000, a connector unit 201 provided to the main body (a main body side connector unit 201) is located at a position opposed to the connector section 119 of the fixation device 100, a left positioning hole 251 is located at a position opposed to the left positioning post 115 of the fixation device 100, and a right positioning hole 252 is located at a position opposed to the right positioning post 116 of the fixation device 100.

As illustrated in FIG. 8B, in the state where the fixation device 100 is mounted to the main body of the image formation apparatus 1000, the connector 113 of the connector section 119 of the fixation device and the connector 211 (see FIG. 10) of the main body of the image formation apparatus 1000 are fitted to each other so as to make an electrical connection therebetween, and the left positioning post 115 and the left positioning hole 251 and the right positioning post 116 and the right positioning hole 252 are respectively fitted to each other so as to position the fixation device 100 with respect to the main body of the image formation apparatus 1000. Next, a configuration of the connector unit 201 of the main body and the fitting between the connector 113 of the fixation device and the connector 211 of the main body are described in detail.

Figure 9:
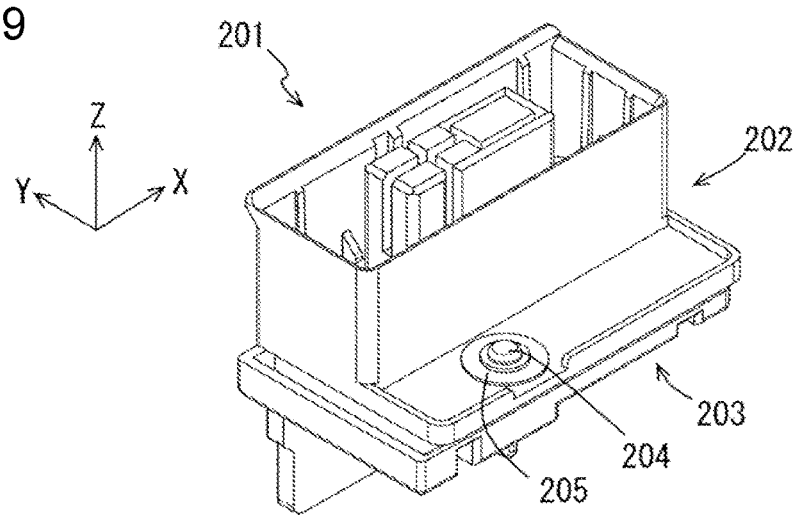
FIG. 9 is a diagram illustrating an external perspective view of a connector unit provided to the main body according to a first embodiment.
Figure 10:
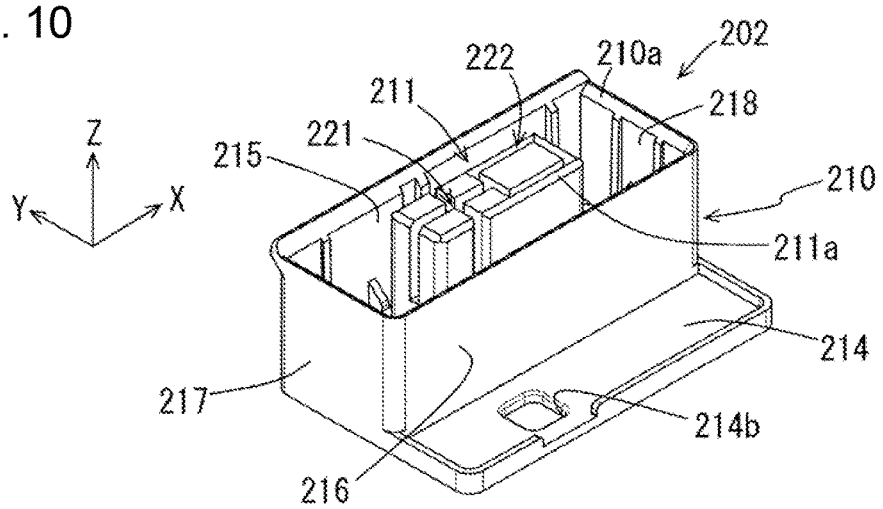
FIG. 10 is a diagram illustrating an external perspective view of a floating unit constituting a part of the connector unit of the main body according to a first embodiment.
Figure 11:
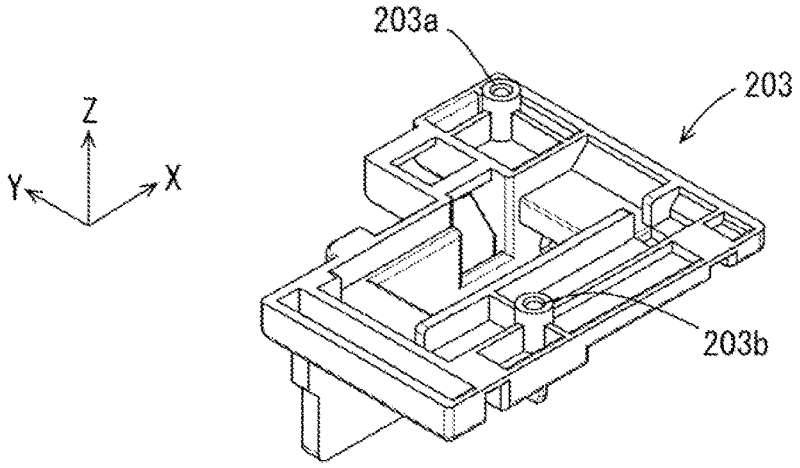
FIG. 11 is a diagram illustrating an external perspective view of a holder guide constituting a part of the connector unit of the main body according to a first embodiment.
Figure 12:
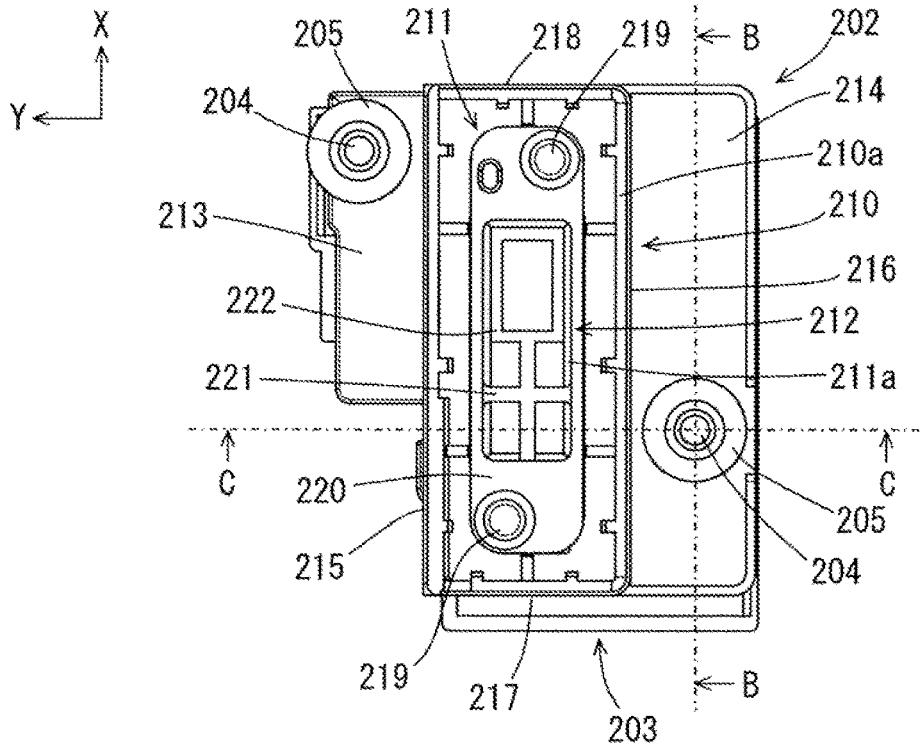
FIG. 12 is a diagram illustrating a top view of the connector unit of the main body according to a first embodiment.
Figure 13:
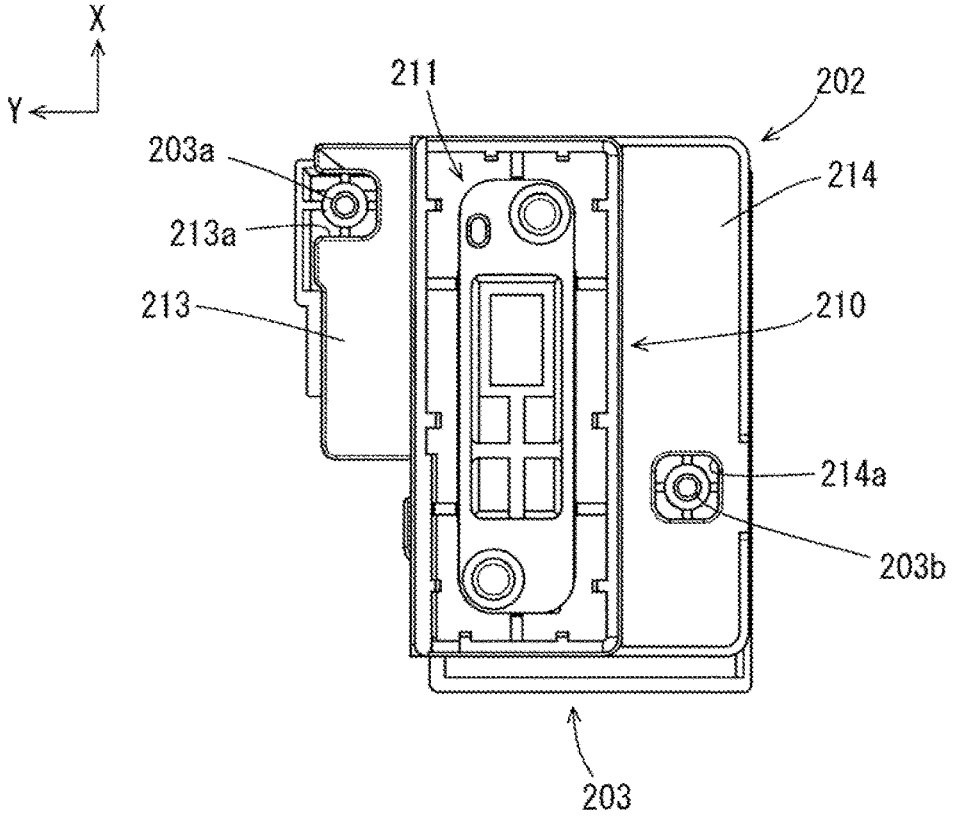
FIG. 13 is a diagram illustrating a top view of the connector unit illustrated in FIG. 12 with screws and flat washers being removed.
Figure 14:
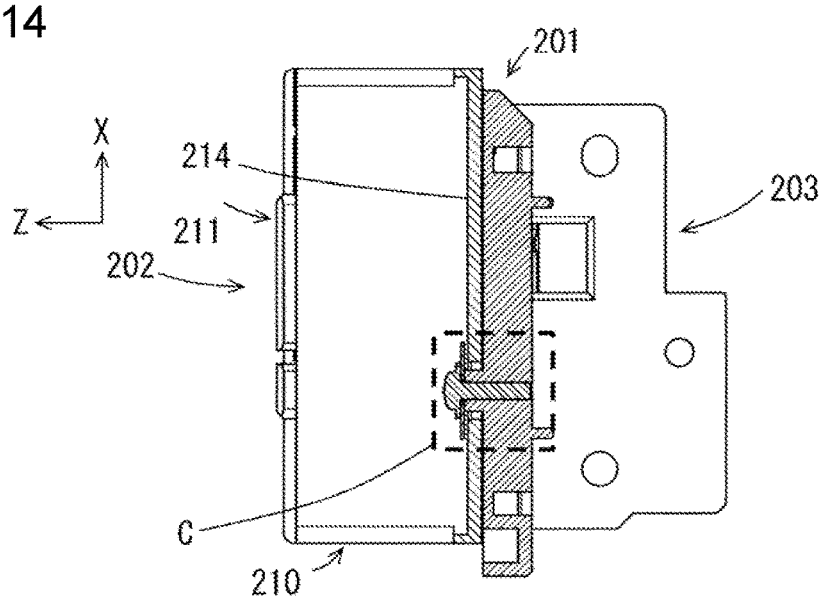
FIG. 14 is a diagram illustrating a cross-sectional view taken along the B-B line in FIG. 12.
Figure 15:
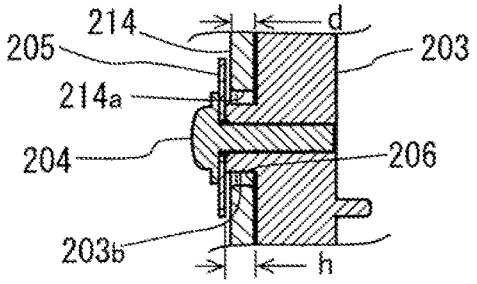
FIG. 15 is a diagram illustrating an enlarged view of a part C enclosed by the dotted line in FIG. 14.
Figure 16:
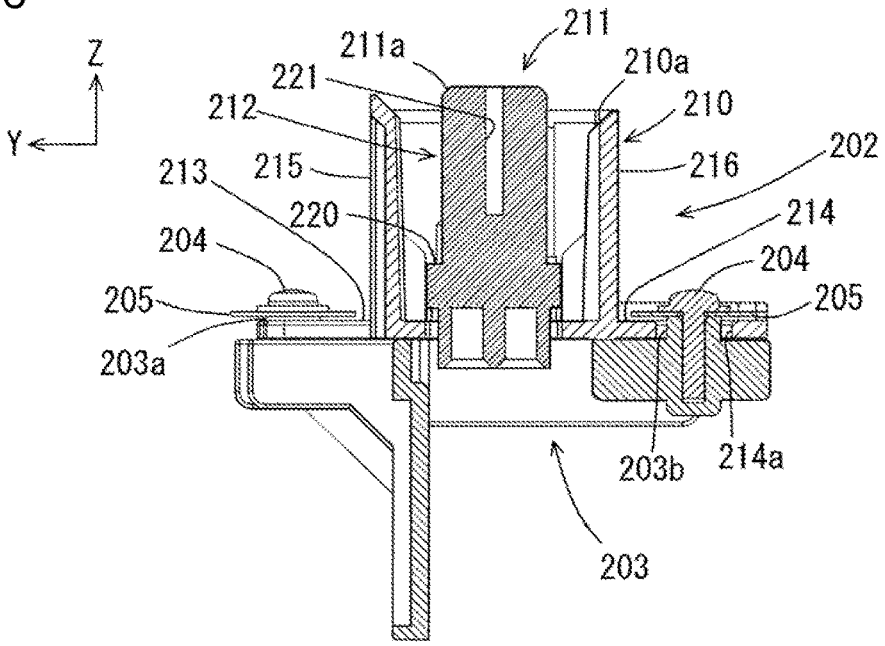
FIG. 16 is a diagram illustrating a sectional view taken along the line C-C in FIG. 12.

FIG. 9 is an external perspective view of the connector unit 201 of the main body, FIG. 10 is an external perspective view of a floating unit 202 constituting a part of the connector unit 201 of the main body, and FIG. 11 is an external perspective view of a holder guide 203 constituting a part of the connector unit 201 of the main body. FIG. 12 is a top view of the connector unit 201 of the main body, FIG. 13 is a view in which the set screw 204 and the flat washer 205 are removed from the connector unit 201 illustrated in FIG. 12, FIG. 14 is a B-B cross-sectional view in FIG. 12, FIG. 15 is a partially enlarged view of the dotted line enclosed portion C in FIG. 14, and FIG. 16 is a cross sectional view taken along the C-C line in FIG. 12. Note that FIGS. 9 to 16 are schematic diagrams schematically illustrating the connector 211 of the main-body with later-described third and fourth connectors 243 and 247 (see FIG. 25B) being omitted.

As illustrated in these figures, the connector unit 201 of the main body includes the floating unit 202 and the holder guide 203. The holder guide 203 is fixed at a predetermined position of the main body of the image formation apparatus 1000 described in FIG. 8.

The floating unit 202 serving as a movable guide member includes a connector housing 210 that accommodates therein the connector 211 of the main body serving as a first connector and a left guide flat surface 213 (FIG. 12) and a right guide flat surface 214 extending from a lower part of the connector housing 210 to the left and right. The connector housing 210 includes four side walls 215, 216, 217, 218 disposed on the left, right, front and rear sides of the connector 211, and the connector 211 is provided inside surrounded by the four side walls.

The connector 211 of the main body is fixed to the connector housing 210 at front and rear end portions of a stationary flat surface 220 of the connector 211 by two fixing screws 219. The connector 211 of the main body includes a protruding portion 212 projecting upwardly from the flat surface 220 in such a manner that the protruding portion 212 serves as a fitting portion (a coupling portion) to be fitted (coupled) with the fitting portion of the connector 113 of the fixation device 100. The protruding portion 212 of the connector 211 is formed with a cross-shaped groove 221 and an annular groove 222. The annular projection 123 (FIG. 6) of the connector 113 of the fixation device is fitted into the annular groove 222 of the connector 211 of the main body and the cross shaped projection 122 (FIG. 6) of the connector 113 of the fixation device is fitted into the cross-shaped groove 221 of the connector 211 of the main body.

An upper end portion of the protruding portion 212 of the connector 211 is formed, at outer circumferential surface thereof, with a taper portion 211*a* as a second taper portion whose taper surface is inclined outwardly. Also, an upper end portion of each of the four side walls 215, 216, 217, and 218 (left, right, front, and rear side walls 215, 216, 217, and 218) of the connector housing 210 of the floating unit 202 is formed, at outer surface thereof, with a taper portion 210*a* as a first taper portion whose taper surface is inclined inwardly. Here, the taper portion 211*a* of the connector 211 is positioned slightly higher than the taper portion 210*a* of the connector housing 210. However, in a first embodiment, the protrusion amount of the taper portion 211*a* of the connector 211 is set to be smaller than the predetermined distance a described above and illustrated in FIG. 7.

As illustrated in FIG. 13, the left guide flat surface 213 of the floating unit 202 is formed with a rectangular-shaped regulation hole 213*a* with one side thereof cut out, and the right guide flat surface 214 of the floating unit 202 is formed with a rectangular-shaped regulation hole 214*a*. On the other hand, in order to hold the floating unit 202 movably, the holder guide 203 is formed with a screw reception post 203*a* and a screw reception post 203*b* having screw holes at the positions facing the regulation holes 213*a* and 214*a* of the floating unit 202 respectively.

An upper part of the holder guide 203 is composed of frame members to place the lower surface of the floating unit 202 in such a manner that upper surfaces of the frame members are flashed (which may be referred to as a placement surface 206). The screw reception posts 203*a*, 203*b* are formed at a height h higher than the placement surface 206, as illustrated in FIG. 15. This height h is set to be larger than the thickness d of the left guide flat surface 213 and the right guide flat surface 214 of the floating unit 202.

The floating unit 202 configured as described above is fixed to the holder guide 203 by the screws, as illustrated in FIG. 9. Upon fixing the floating unit 202 to the holder guide 203, the floating unit 202 is placed on the placement surface 206 of the holder guide 203 in such a manner that the screw reception post 203*a* of the holder guide 203 passes through the regulation hole 213*a* of the floating unit 202 and the reception post 203*b* passes through the regulation hole 214*a*. Thereafter, the set screws 204 are screwed to the screw holes of respective screw reception posts 203*a*, 203*b* via the flat washers 205 that cover the regulation holes 213*a*, 214*a*, so that the flat washers 205 are fixed to the tops of the screw reception post 203*a*, 203*b* respectively.

FIG. 15 is diagram illustrating the cross-sectional view illustrating the positional relationship at this stage between the placement surface 206 and the reception post 203*b* of the holder guide 203, the regulation hole 214*a* of the right guide flat surface 214, and the flat washer 205.

As illustrated in FIG. 15, the regulation hole 214*a* is formed larger than the outer diameter of the reception post 203*b* so that a predetermined gap exists, which causes a small space between the flat washer 205 and the upper surface of the right guide flat portion 214 that allows sliding of the floating unit 202 with respect to the holder guide 203. This is also true in the relationship between the screw reception post 203*a* and its peripheral components.

Accordingly, the floating unit 202 is held by the holder guide 203 in such a manner that the floating unit 202 is movable in all directions on the placement surface 206 (the plane perpendicular to the Z-axis) by the amount of the gap between the reception post 203*b* and the regulation hole 214*a*, while the movement of the floating unit 202 in the vertical direction (Z-axis direction) is regulated by the flat washer 205.

As explained referring to FIG. 8, the connector unit 201 configured as described above is arranged at a position almost opposed (aligned) to the connector section 119 provided to the fixation device when the left and right positioning posts 115 and 116 of the fixation device 100 are respectively fitted into the left and right positioning holes 251 and 252 of the main body of the image formation apparatus 1000.

FIGS. 17 to 23 are operation explanatory diagrams for explaining how the connector section 119 and the left positioning post 115 provided to the fixation device 100 interact with the connector unit 201 and the left positioning hole 251 provided to of the main body of the image formation apparatus 1000 when the fixation device 100 is being moved from the detached position (illustrated in FIG. 8A) above and away from a mount position (illustrated in FIG. 8B) where the fixation device 100 is mounted to the image formation apparatus main body, to the mount position (illustrated in FIG. 8B). With reference to these figures, movements of the fixation device 100 while the fixation device 100 is being moved from the detached position where the fixation device 100 is separated from the image formation apparatus 1000 main body to the mount position where the fixation device 100 is mounted to the image formation apparatus 1000 main body is described. In FIGS. 17 to 23, the connector 113 of the fixation device and the connector 211 of the main body are illustrated in abbreviated manners excluding the respective connectors described below.

Figure 17:
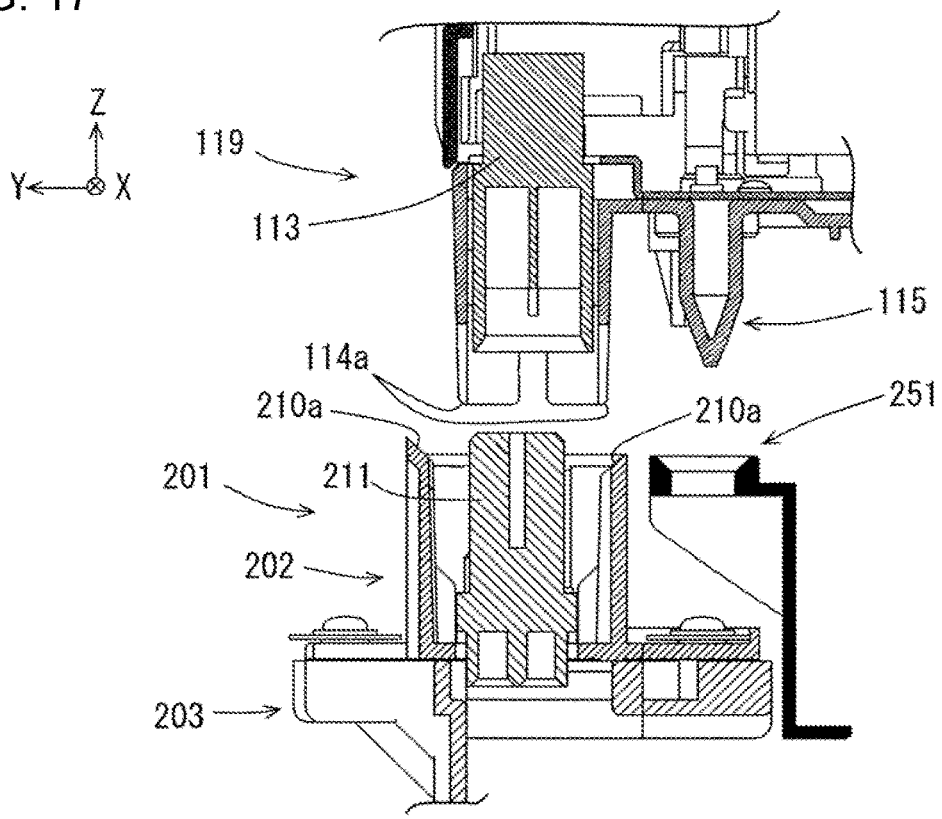
FIG. 17 is a diagram illustrating an explanatory view for explaining a process for mounting the fixation device to the main body of the image formation apparatus.

FIG. 17 illustrates a positional relationship between the connector unit 201 of the main body and the connector section 119 of the fixation device in a state where the fixation device 100 is located above and slightly displaced to the right with respect to the mount position of the fixation device 100 to the image formation apparatus 1000 main body. In this initial state, the floating unit 202 is assumed to be located at the center of the movable area in the X-Y plane relative to the holder guide 203.

Figure 18:
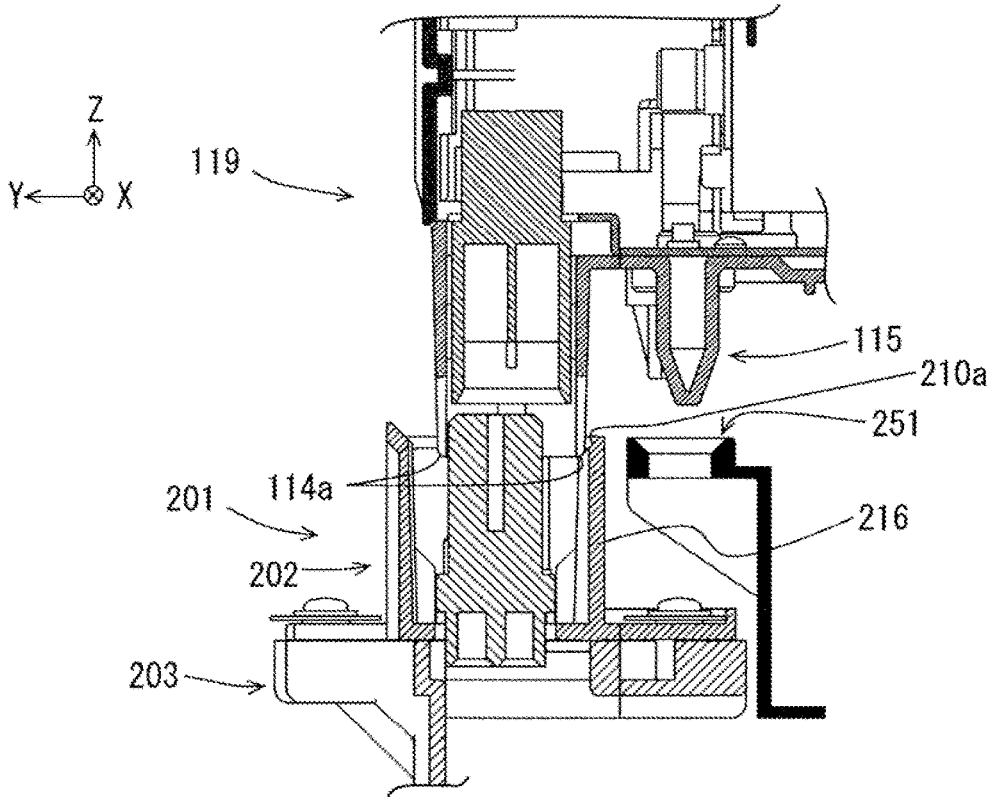
FIG. 18 is a diagram illustrating an explanatory view for explaining the process for mounting the fixation device to the main body of the image formation apparatus.

When the fixation device 100 is moved downward (in the minus direction of the Z-axis) from the state illustrated in FIG. 17, firstly, the taper portion 114*a* of the connector section 119 of the fixation device comes in contact with the taper portion 210*a* formed at a tip of the right side wall 216 of the connector unit 201 of the main body as illustrated in FIG. 18.

Figure 19:
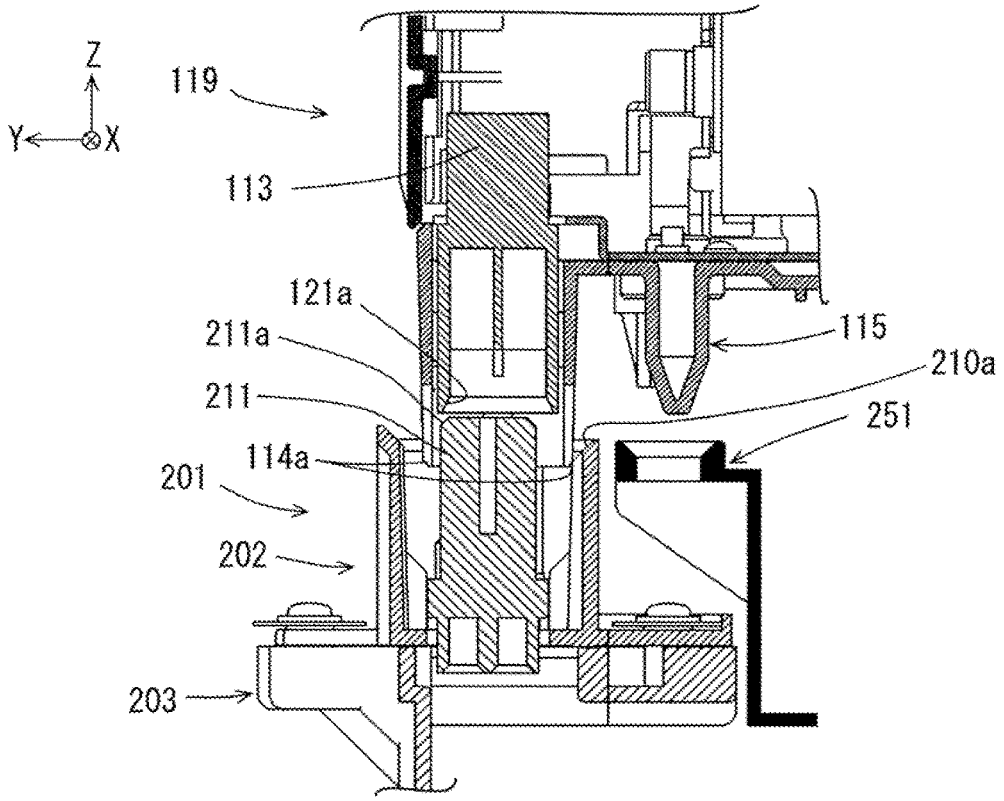
FIG. 19 is a diagram illustrating an explanatory view for explaining the process for mounting the fixation device to the main body of the image formation apparatus.

When the fixation device 100 is moved further downward from the state illustrated in FIG. 18, the fixation device 100 receives a leftward force and the floating unit 202 receives a rightward force due to the action of the taper portions being in contact with each other, and thus the fixation device 100 and floating unit 202 move in the directions opposite to each other. Note that the movement amounts of the fixation device 100 and the floating unit 202 here depend on the force applied by an operator who holds the handle 105 of the fixation device 100 and installs the fixation device 100, the position of the floating unit 202 in the movable area in the X-Y plane with respect to the holder guide 203 in the initial state illustrated in FIG. 17, the mass of the fixation device 100 and the mass of the floating unit 202, and the like. Here, it is assumed that the fixation device 100 moves slightly to the left and the floating unit 202 moves slightly to the right while the taper portions slide against each other. FIG. 19 illustrates the state at the end of sliding between the taper portions.

By the relative movements of the fixation device 100 and the floating unit 202 described above, the connector section 119 of the fixation device moves in the direction to the center of the connector housing 210 (see FIG. 10) provided to the floating unit 202 along the left-right direction (Y-axis direction). When the relative movements end as illustrated in FIG. 19, the connector section 119 of the fixation device have been moved to a position (a fittable range) where the taper portion 121*a* of the connector 113 of the fixation device and the taper portion 211*a* of the connector 211 of the main body can contact (engage) with each other, or in other words, where the connector 113 of the fixation device can be fitted into the connector 211 of the main body by moving the fixation device 100 downward. Thereafter, the relative movements described above may be referred to as a guiding movement.

At this stage, the taper portion 121*a* of the connector 113 of the fixation device and the taper portion 211*a* of the connector 211 of the main body are not yet in contact with each other. This is because the positions and shapes of the four tapers (the taper portion 121*a* of the connector 113 of the fixation device, the taper portion 211*a* of the connector 211 of the main body, the taper portion 114*a* of the connector guide portion 114 of the fixation device, and the taper portion 210*a* of the connector housing 210) are set in such a manner that sliding between the taper portion 114*a* of the connector guide portion 114 of the fixation device (FIG. 2) and the taper portion 210*a* of the connector housing 210 (FIG. 10) ends (that is, the guiding movement is completed) before the connectors starts to contact each other.

Figure 20:
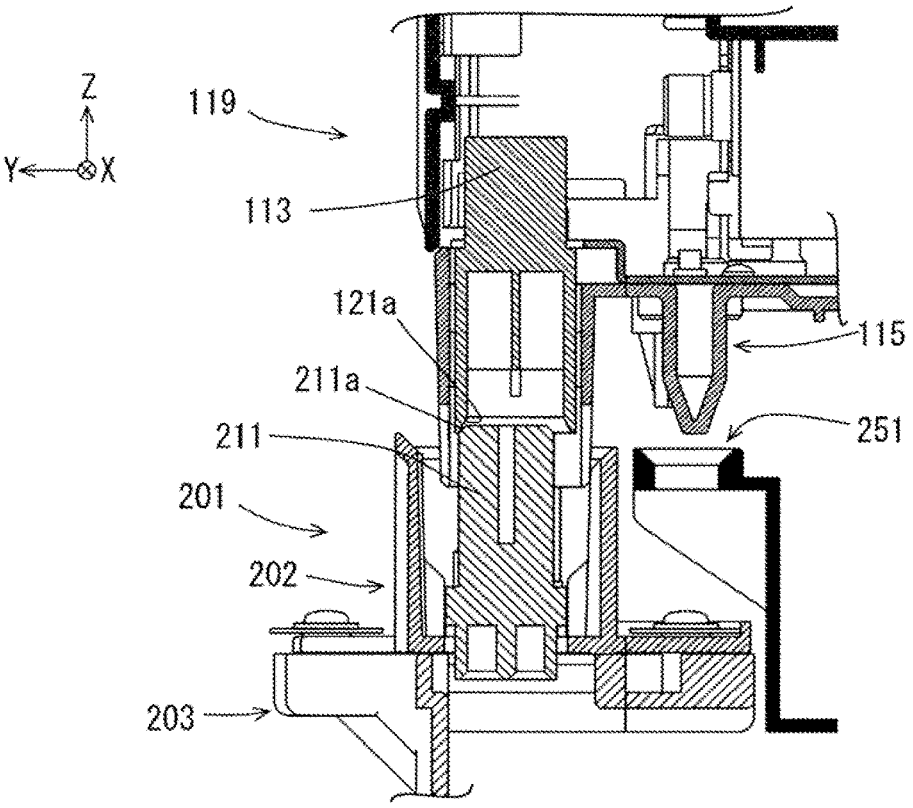
FIG. 20 is a diagram illustrating an explanatory view for explaining the process for mounting the fixation device to the main body of the image formation apparatus.
Figure 21:
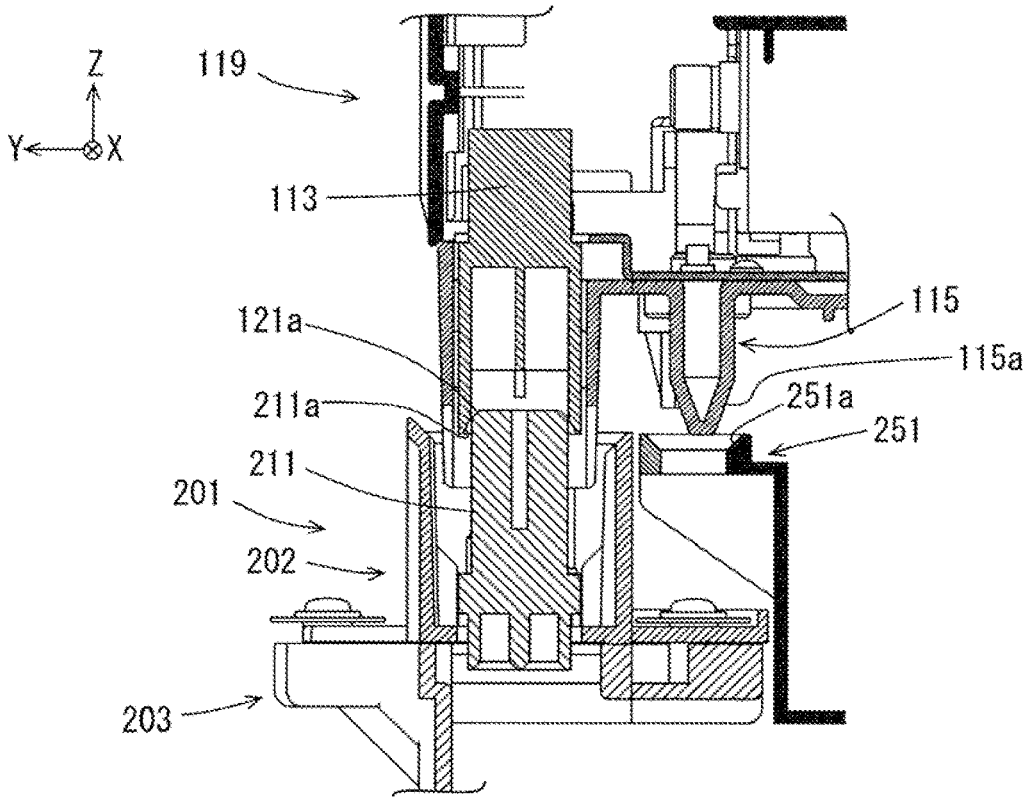
FIG. 21 is a diagram illustrating an explanatory view for explaining the process for mounting the fixation device to the main body of the image formation apparatus.

When the fixation device 100 moves downward further from the state illustrated in FIG. 19, the taper portion 121*a* of the connector 113 of the fixation device and the taper portion 211*a* of the connector 211 of the main body come into contact as illustrated in FIG. 20. When the sliding of the taper portions 121*a* and 211*a* ends as illustrated in FIG. 21, the positional misalignment between the connector 113 of the fixation device and the connector 211 of the main body in the left-right direction (Y-axis direction) is eliminated. Note that when the taper portions 121*a* and 211*a* slide against each other, the fixation device 100 and the floating unit 202 move relative to each other, while the floating unit 202 is assumed to slightly move to the right in this example.

Figure 27:
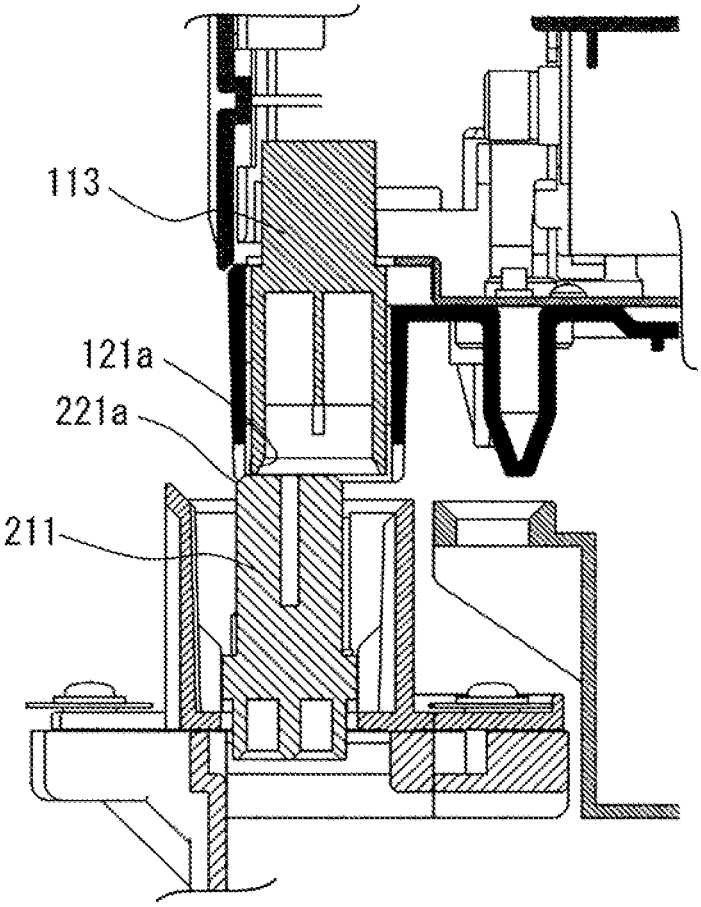
FIG. 27 is a diagram for explaining a case where guiding movement is not sufficiently performed at the stage of the operation illustrated in FIG. 20.

FIG. 27 illustrates a case where the above-mentioned guiding movement is not sufficiently performed at the movement process illustrated in FIG. 20. In such a case, the taper portion 121*a* of the connector 113 of the fixation device and the taper portion 211*a* of the connector 211 of the main body cannot reach a position where they come in contact with (engage with) each other, and thus the connector 113 of the fixation device cannot be fitted into the connector 211 of the main body.

Figure 22:
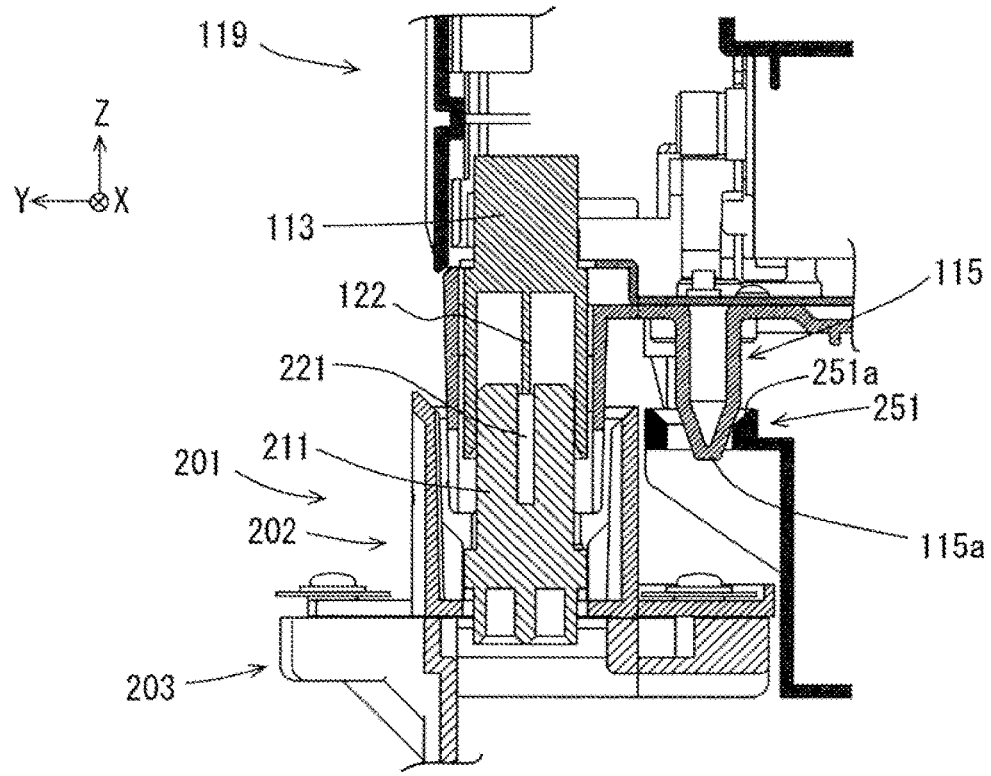
FIG. 22 is a diagram illustrating an explanatory view for explaining the process for mounting the fixation device to the main body of the image formation apparatus.

When the fixation device 100 moves downward further from the state of FIG. 21, the cross shaped projection 122 and the annular projection 123 (see FIG. 6) of the connector 113 of the fixation device is being inserted into the cross shaped groove 221 and the annular groove 222 (see FIG. 10) of the connector 211 of the main body respectively as illustrated in FIG. 22, and thus the two connectors 113 and 211 integrally move in the X-Y plane, that is, the fixation device 100 and the floating unit 202 integrally move in the X-Y plane.

Further, as illustrated in FIG. 22, an inclined surface of a tapered tip portion 115*a* of the left positioning post 115 of the fixation device 100 contacts an introduction taper portion 251*a* formed in an upper part of the left positioning hole 251 arranged in the image formation apparatus 1000 main body.

In this example, it is assumed that the fixation device 100 is slightly displaced to the right before the connector 113 of the fixation device is inserted into the connector 211 of the main body. This displacement is consequently attributed to the fact that the floating unit 202 moves slightly to the right from the initial position within the movable range until the connector 113 of the fixation device and the connector 211 of the main body integrally move in the X-Y direction.

Figure 23:
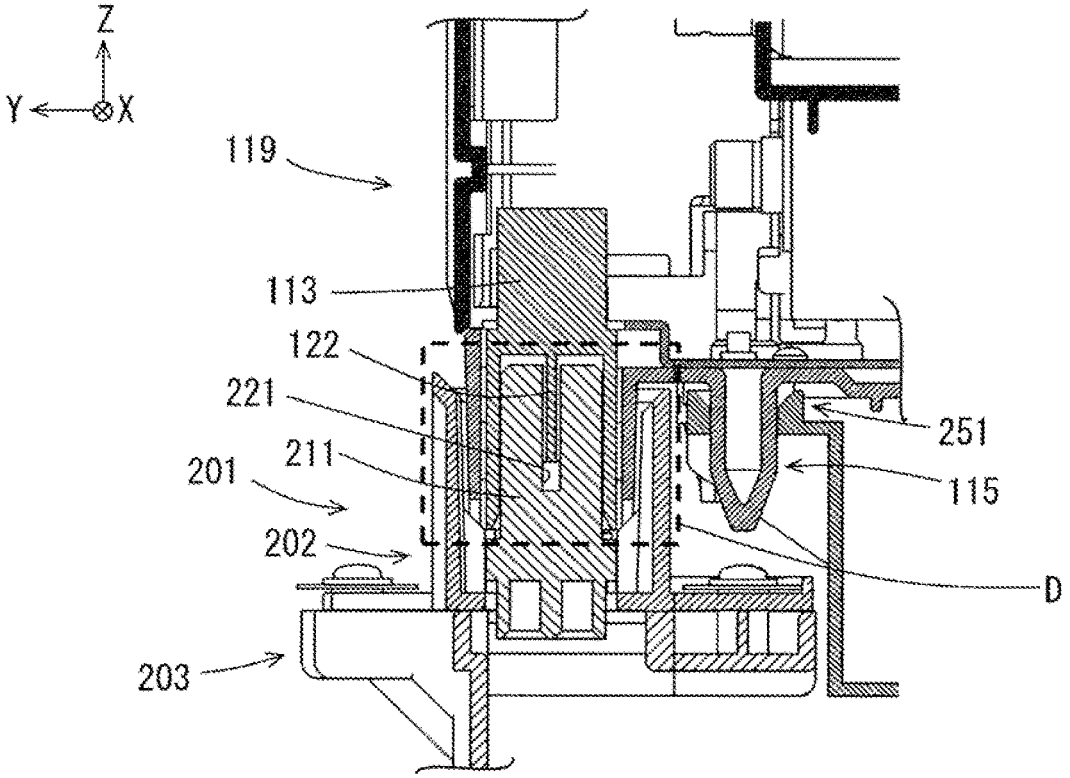
FIG. 23 is a diagram illustrating an explanatory view for explaining the process for mounting the fixation device to the main body of the image formation apparatus.

When the fixation device 100 moves downward further from the state illustrated in FIG. 22, the left positioning post 115 of the fixation device 100 moves downward while being guided to the left slightly by the left positioning hole 251 of the image formation apparatus 1000 main body, and then the fixation device 100 is eventually mounted to the main body of the image formation apparatus 1000 in a state where the left positioning post 115 is completely fitted into the left positioning hole 251, as illustrated in FIG. 23.

In this process, the floating unit 202 also moves in the left direction together with the fixation device 100. Thus, the connector 113 of the fixation device can move downward to the mount position illustrated in FIG. 23 without receiving a large load in the left-right direction and in the front-back direction. In the mount position illustrated in FIG. 23, the vertical movement of the fixation device 100 is locked by a regulation part or a regulation device (not illustrated).

Note that, the positions of the regulation holes 214*a* and the like is set in such a manner the center of the set screw 204 illustrated in FIG. 12 is positioned at substantially the center of the regulation hole 214*a* of the floating unit 202 at the position where the floating unit 202 has been moved together with the fixation device 100 to the left.

Figure 24:
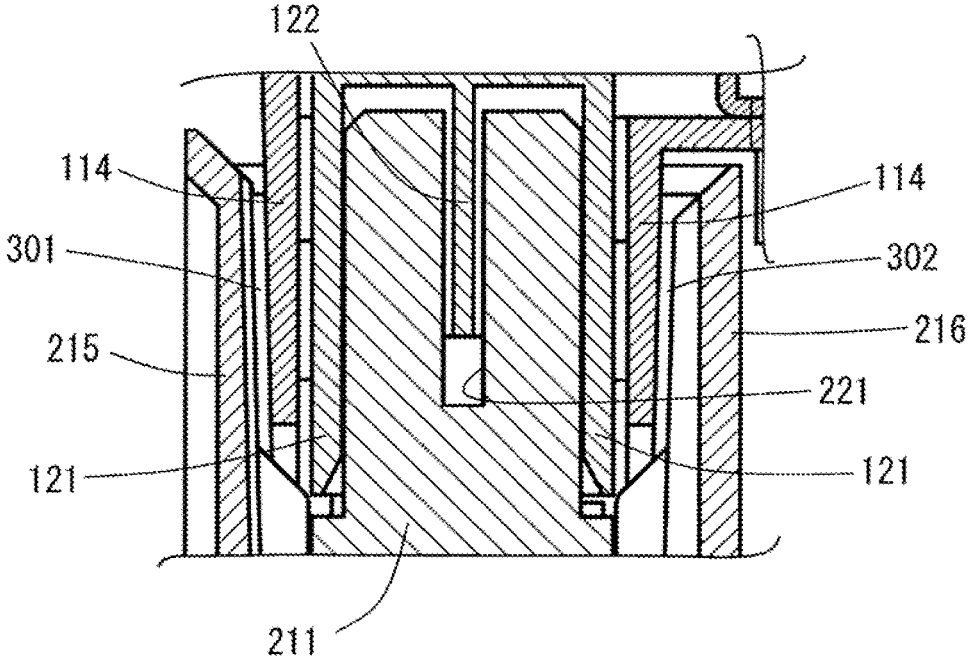
FIG. 24 is a diagram of an enlarged partial view illustrating a coupling portion between the connectors, indicated by the dotted line D in FIG. 23.

FIG. 24 is a diagram of an enlarged partial view illustrating a coupling portion (a mating portion) between the connectors, indicated by the dotted line D in FIG. 23. As illustrated in FIG. 24, predetermined spaces 301 and 302 are formed between the left and right side walls 215 and 216 of the floating unit 202 and the connector guide portion 114 of the fixation device 100.

With this configuration, relative positioning (alignment) of the fixation device 100 and the floating unit 202 is determined by the coupling (the mating) of the connector 113 of the fixation device and the connector 211 of the main body. Thus, the guiding movement by means of the connector guide portion 114 and the floating unit 202 is not involved in the final alignment of the connectors 113 and 211 and is only involved to an extent that the connectors 113 and 211 can start to be fitted to each other by using the taper portions thereof.

Figure 25A:
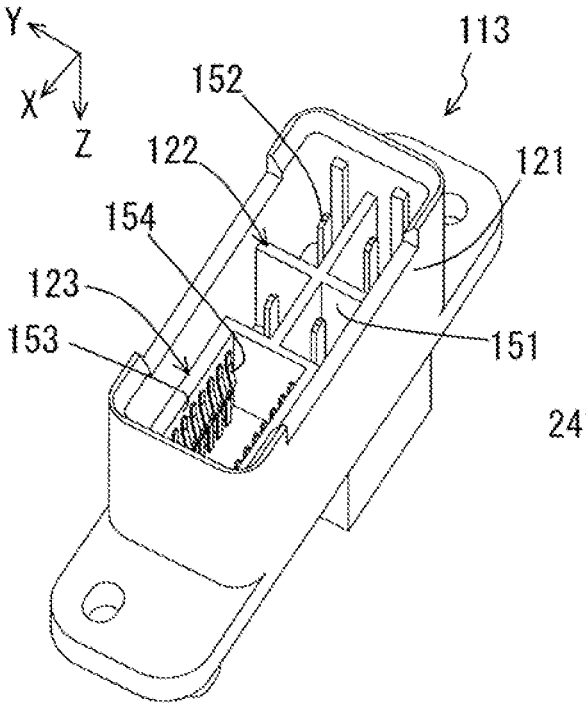
FIG. 25A is a diagram illustrating an external perspective view of a coupling side of the connector of the fixation device viewed from diagonally above.
Figure 25B:
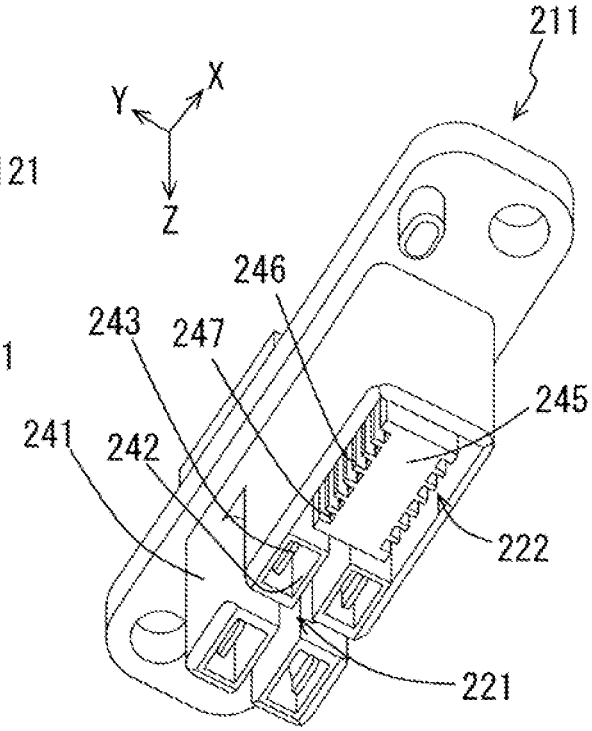
FIG. 25B is a diagram illustrating an external perspective view of a coupling side of the connector of the main body viewed from diagonally below.
Figure 25C:
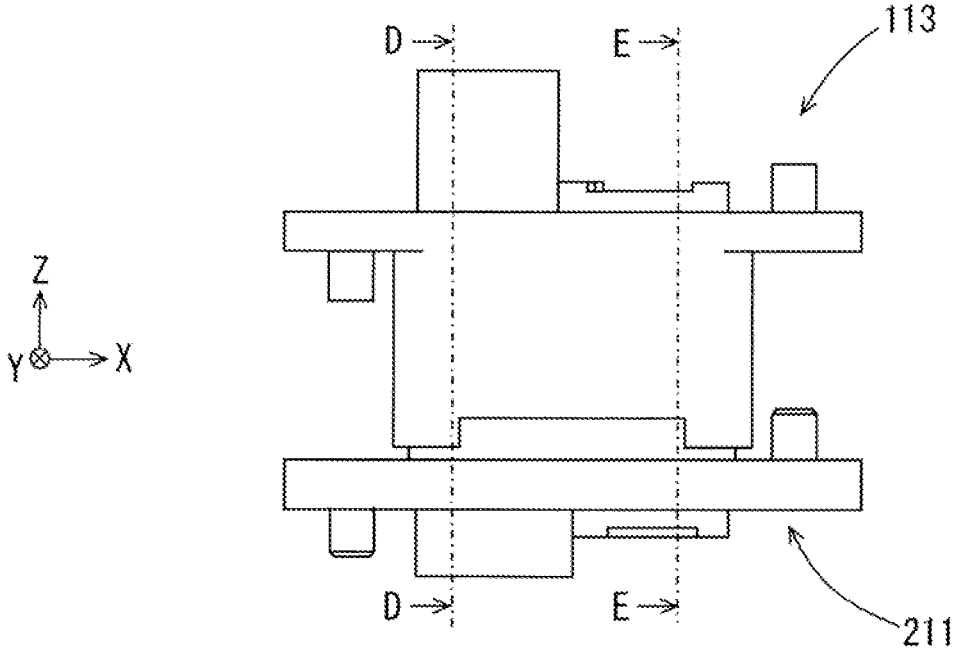
FIG. 25C is a diagram illustrating a side view of the connectors in the connected state viewed from the right side.
Figure 26A:
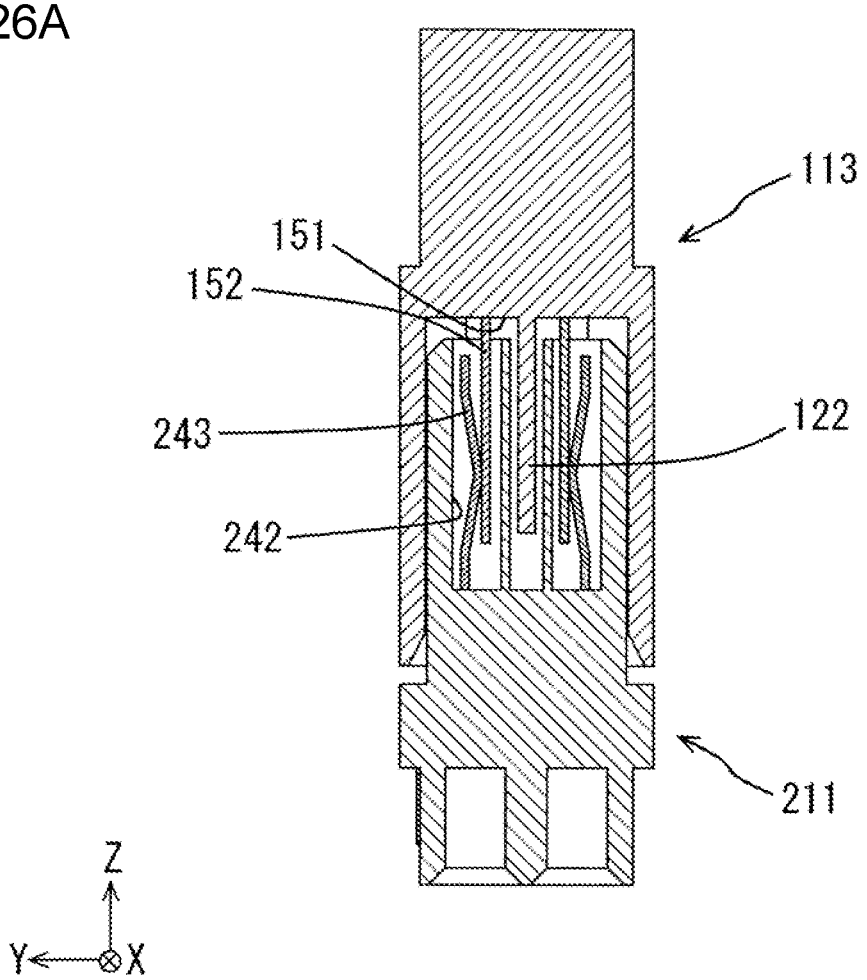
FIG. 26A is a diagram illustrating a cross-sectional view taken along the D-D line in FIG. 25C.
Figure 26B:
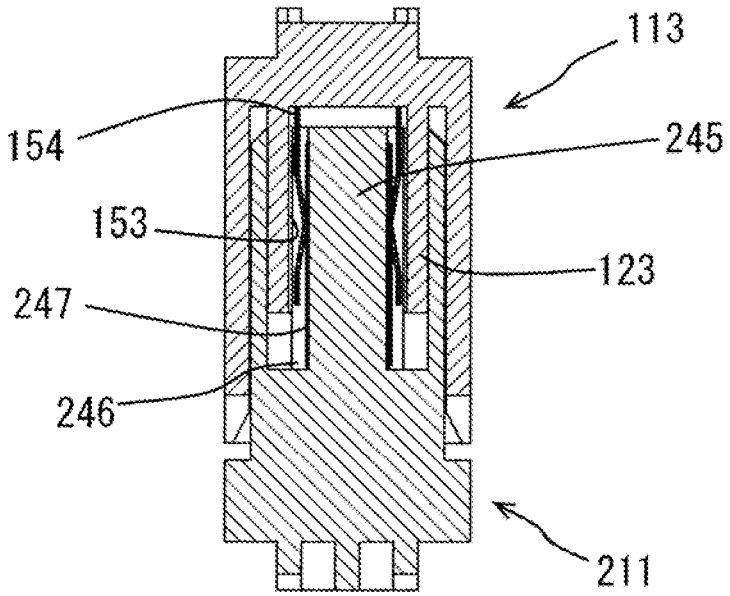
FIG. 26B is a diagram illustrating a cross-sectional view taken along the E-E line in FIG. 25C.

Here, contact terminals (electrodes) of each of the connector 113 of the fixation device and the connector 211 of the main body are described. FIG. 25A is a diagram illustrating an external perspective view of the coupling side (the mating side) of the connector 113 of the fixation device viewed from diagonally above, FIG. 25B is a diagram illustrating an external perspective view of the coupling side (the mating side) of the connector 211 of the main body viewed from diagonally below, and FIG. 25C is a diagram illustrating a side view of the connectors 113 and 211 in the coupled state (the fitted state) viewed from the right side. FIG. 26A is a diagram illustrating a cross-sectional view taken along the D-D line in FIG. 25C, and FIG. 26B is a diagram illustrating a cross-sectional view taken along the E-E line in FIG. 25C.

As illustrated in FIG. 25A, four first contact terminals 152 are provided respectively in four areas 151 defined by the cross shaped projection 122 in the connector 113 of the fixation device, and each of the four first contact terminal is hung downwardly. Along each of left and right inner wall surfaces 153 of the annular projection 123, seven second contact terminals 154 (see FIG. 26B) having elasticity extend downwardly at equal intervals and are curved inwardly in an L-shape. That is, in the annular projection 123, fourteen contact terminals 154 are provided in total.

To the contrary, as illustrated in FIG. 25B, the cross shaped groove 221 of the connector 211 of the main body is defined by four rectangular columns 241 provided with reception holes 242 for receiving the first contact terminals 152. In each of the reception holes 242 of the columns 241, the third contact terminal 243 (see FIG. 26A) having an elasticity and curved inwardly in an L-shape is planted. Each of left and right side wall surfaces of the inner block 245 defining the annular groove 222 is formed with seven successive concave-convex portions 246, and a fourth contact terminal 247 is provided along a bottom of each concave portion of the concave-convex portions 246.

FIG. 25C is the diagram illustrating the side view of the coupled state (the fitted state) of the connector 113 of the fixation device and the connector 211 of the main body, in the state where the fixation device 100 is finally mounted on the image formation apparatus 1000 main body as illustrated in FIG. 23.

In this coupled state, the rectangular columns 241 of the connector 211 of the main body are respectively fitted to the four areas 151 of the connector 113 of the fixation device, and the four pairs of the first and third contact terminals 152 and 243 respectively press against each other in the reception holes 242 of the rectangular columns 241 as illustrated in FIG. 26A, so as to form an electrical connection state. To the contrary, the fourteen pairs of the second and fourth contact terminals 154 and 247 respectively press against each other in the fourteen concave portions of the concave-convex portions 246 of the connector 211 of the main body as illustrated in FIG. 26B, to form an electrical connection.

Accordingly, in the state where the fixation device 100 is mounted on the main body of the image formation apparatus 1000, a total of eighteen electrical connections can be secured therebetween to transmit a power supply, a temperature information signal, and the like.

Since the electrical connections between the contact terminals are secured by pressure contact, it may be desired that the connector 113 of the fixation device and the connector 211 of the main body be fitted (mated) without stress. In this respect, in a first embodiment, as explained with reference to FIG. 24, the predetermined spaces 301 and 302 are secured between the left and right side walls 215 and 216 of the floating unit 202 and the connector guide portion 114 of the fixation device 100, and thus external stress due to the mounting operation does not affect fitting of the connector 113 of the fixation device and the connector 211 of the main body.

Note that the taper portion 114*a* of the connector guide portion 114, the taper portion 121*a* of the connector 113 of the fixation device, and the taper portion 211*a* of the connector 211 of the main body are assumed to be configured in the same positional relationship and the same shape in each of the front, rear, left, right, and corner directions. Accordingly, although the foregoing description describes the case where mounting is started with the fixation device 100 shifted to the right, a first embodiment operates in the same manner in all the directions, including the guiding movement.

Not that, in the forgoing description, the process of mounting is performed in an order starting with the guiding movement, the fitting of the connectors, and the fitting of the left positioning post 115 and the left positioning hole 251 for the alignment. However, the order is not limited to this order, and the fitting for the alignment may start before the guiding movement or before the fitting of the connectors. Even if the fitting for the alignment starts before the guiding movement or before the fitting of the connectors, the smooth fitting operation of the connectors along with the guiding movement is not hindered.

In a first embodiment, the pair of the taper portions are provided to the connector guide portion 114 of the fixation device and the connector 113 of the fixation device, and the pair of the taper portions are provided to the connector 113 of the fixation device and the connector 211 of the main body. However, the disclosure is not limited thereto, and various other configurations may be possible, such as a configuration in which a taper portion is provided to one of the pair and an engaging portion, to be in contact with the taper portion, is provided to the other of the pair.

As described above, according to the image formation apparatus according to a first embodiment, upon mounting the fixation device 100 to the main body of the image formation apparatus 1000, first, the taper portion 114*a* of the connector guide portion 114 and the taper portion 210*a* of the floating unit 202 come in contact to perform the guiding movement to move the connector 113 of the fixation device to the position (the fittable range) where the taper portion 121*a* of the connector 113 of the fixation device and the taper portion 211*a* of the connector 211 of the main body can come in contact with each other. Therefore, the allowable range of misalignment of the fixation device 100 to the mine body of the image formation apparatus 1000 at the time of mounting of the fixation device 100 to the main body of the image formation apparatus 1000 can be expanded. Also, within this allowable range, the top surfaces of the connectors do not collide with each other, preventing the connectors from being damaged.

Also, since substantially no external stress is applied to the connector 113 of the fixation device and the connector 211 of the main body when the mounting is completed, the reliability of the electrical connection between the connectors can be improved. Further, since the floating unit 202 is configured to be slidably movable with respect to the main body of the image formation apparatus 1000, misalignment between the connector 113 of the fixation device and the connector 211 of the main body can be allowed.

Second Embodiment

Figure 28A:
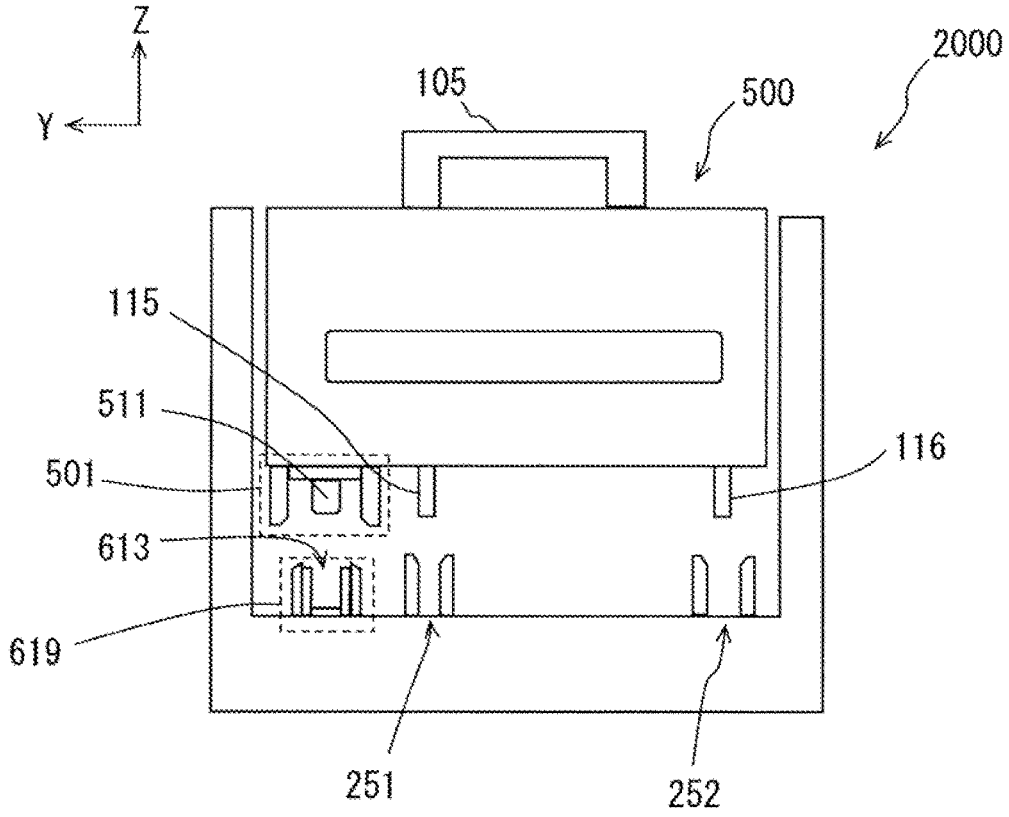
Figure 28B:
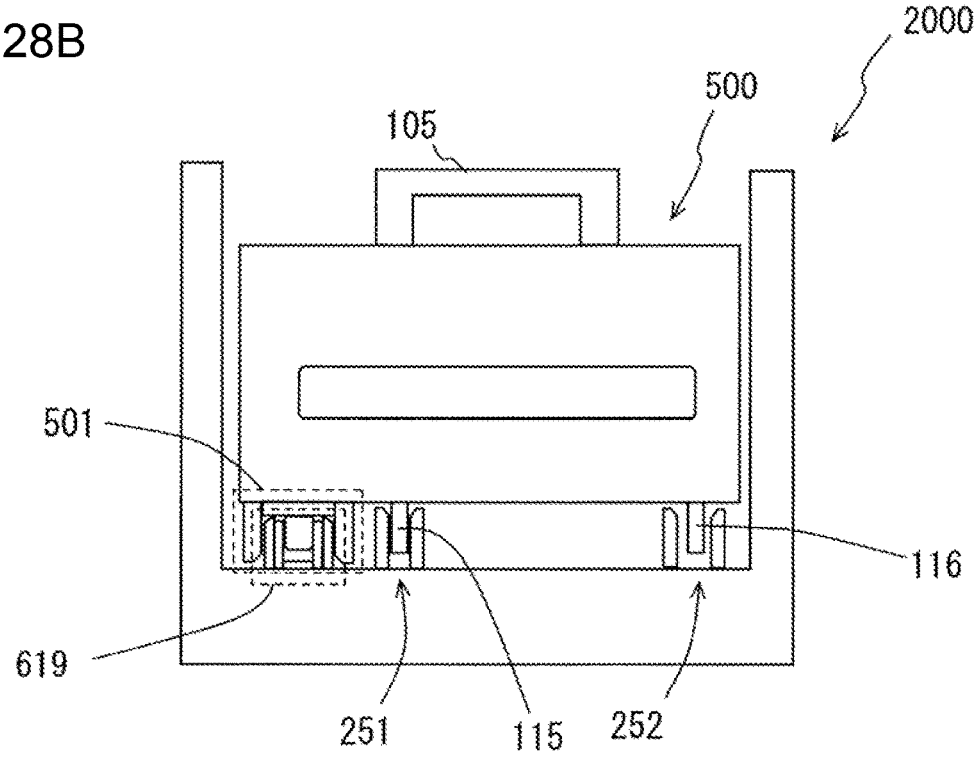

FIGS. 28A and 28B are diagrams illustrating a main configuration of an image formation apparatus 2000 according to a second embodiment. FIG. 28A illustrates a state in which a fixation device 500 as a detachable unit is removed upwardly from the main body of the image formation apparatus 2000, and FIG. 28B illustrates a state in which the fixation device 500 is mounted on the main body of the image formation apparatus 2000.

A main difference between the image formation apparatus 2000 according to a second embodiment and the image formation apparatus 1000 according to a first embodiment illustrated in FIG. 8 is an arrangement relationship of the connector section 119 of the fixation device and the connector unit 201 of the main body. Therefore, parts of the image formation apparatus 2000 according to a second embodiment that are in common with the image formation apparatus 1000 according to a first embodiment are omitted from the following description for avoiding redundancies, by designating with the same references or by omitting illustration of the parts in the figures, and the difference will be described with emphasis.

As illustrated in FIGS. 28A and 28B, in the image formation apparatus 2000, a connector section 619 corresponding to the connector section 119 provided to the fixation device 100 such as being illustrated in FIG. 8 according to a first embodiment is provided to the main body of the image formation apparatus 2000, and a connector unit 501 corresponding to the connector unit 201 provided to the main body of the image formation apparatus 1000 such as being illustrated in FIG. 8 according to a first embodiment is provided to the fixation device 500. The connector section 619 provided to the main body according to a second embodiment has a configuration same as but is provided in a vertical orientation opposite to the connector section 119 provided to the fixation device according to a first embodiment, and the connector unit 501 provided to the fixation device 500 according to a second embodiment has a configuration same as but is provided in a vertical orientation opposite to the connector unit 201 provided to the main body according to a first embodiment.

Accordingly, with this configuration, when the fixation device 500 is moved, from a position (see FIG. 28A) above and away from a mount position (see FIG. 28B) where the fixation device 500 is mounted to the main body of the image formation apparatus 2000, to the mount position so as to mount the fixation device 500 to the main body the image formation apparatus 2000, movements of the components according to a second embodiment correspond to the movements of the components according to a first embodiment illustrated in FIGS. 17 to 23 except for the vertical positional relationship between the connector section 119 of the fixation device and connector unit 201 of the main body according to a first embodiment is reversed.

Therefore, in the course of moving the fixation device 500 from the detached position illustrated in FIG. 28A to the mount position illustrated in FIG. 28B, the connector 613 provided to the main body serving as a second connector and the connector 511 provided to the fixation device serving as a first connector are fitted to each other along with the guiding movement as in the operations according a first embodiment illustrated in FIGS. 17 to 23. Accordingly, a detailed explanation of the movements of the components according to a second embodiment in the course of moving the fixation device 500 from the detached position illustrated in FIG. 28A to the mount position illustrated in FIG. 28B is omitted for avoiding redundancies.

As described above, in the image formation apparatus 2000 according to a second embodiment, the allowable range of misalignment of the fixation device 500 to the main body of the image formation apparatus 2000 upon mounting the fixation device 500 to the main body of the image formation apparatus 200 can be expanded in the same manner as in the image formation apparatus 1000 according to a first embodiment.

Also in a second embodiment, external stress is not affected to the fitting of the connector 613 of the main body and the connector 511 of the fixation device at the time when the mounting of the fixation device is completed, and thus the reliability of the electrical connection between the connectors can be improved. Further, in a second embodiment, the floating unit is configured to be slidably movable with respect to the fixation device 500, and this allows misalignment of the connector 613 of the main body and the connector 511 of the fixation device.

Third Embodiment

Figure 29A:
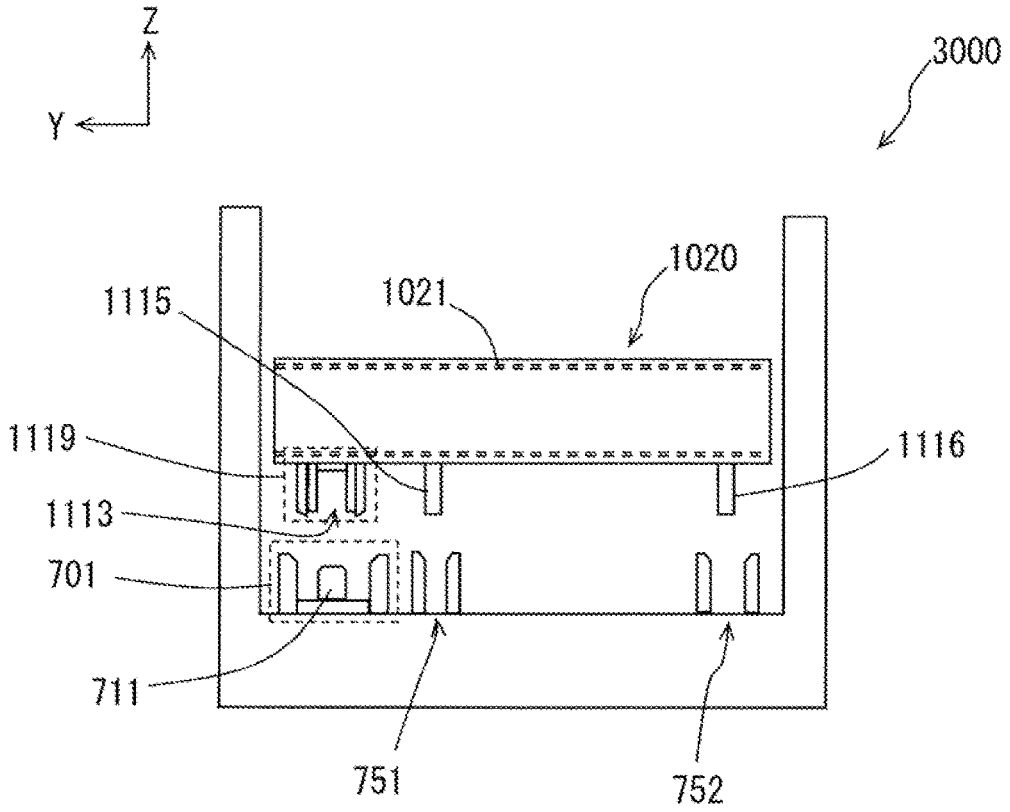
Figure 29B:
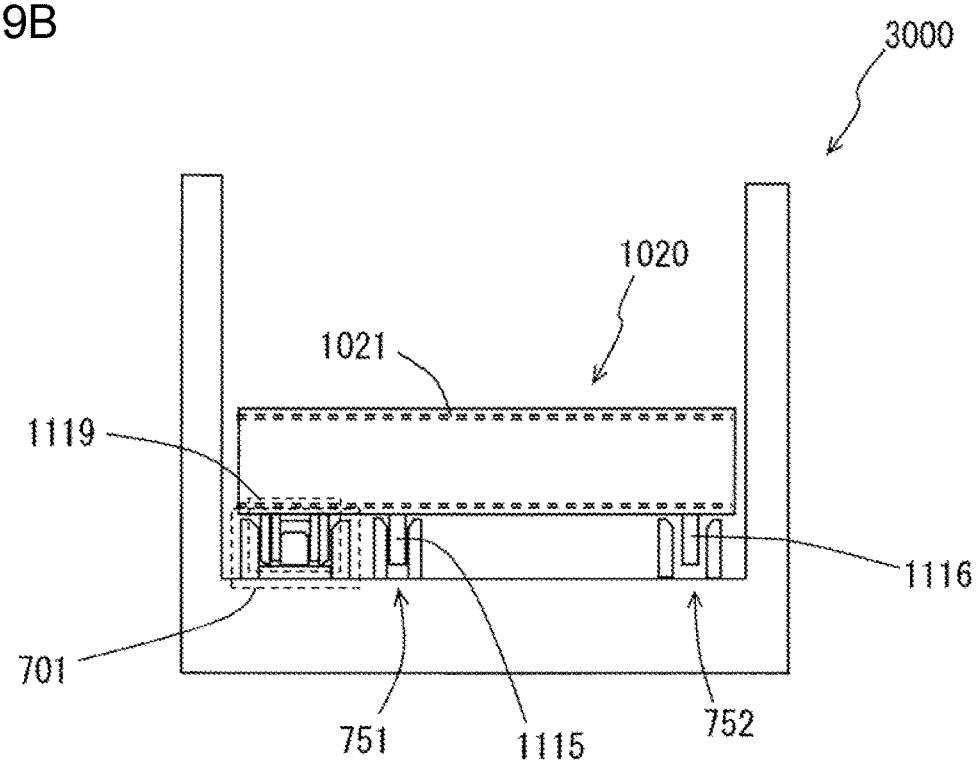

FIGS. 29A and 29B are diagrams illustrating a main configuration of an image formation apparatus 3000 according to a third embodiment. FIG. 29A illustrates a state in which a transfer device 1020 serving as a detachable unit is removed upwardly from a main body of an image formation apparatus 3000, and FIG. 29B illustrates a state in which the transfer device 1020 is mounted to the main body of the image formation apparatus 3000.

A main difference between the image formation apparatus 3000 according to a third embodiment and the image formation apparatus 1000 according to a first embodiment such as being illustrated in FIG. 8 is that a main body of the image formation apparatus 3000 and a transfer device 1020 that is detachable from the image formation apparatus 3000 main body are provided with a connector unit 701 (a main-body-side connector unit 701) and a connector section 1119 (a transfer-device-side connector section 1119, respectively, as well. Therefore, parts of the image formation apparatus 3000 according to a third embodiment that are in common with the image formation apparatus 1000 according to a first embodiment are omitted from the following description for avoiding redundancies, by designating with the same references or by omitting illustration of the parts in the figures, and the difference will be described with emphasis.

As illustrated in FIGS. 29A and 29B, in the image formation apparatus 3000 according to a third embodiment, the connector section 1119 provided to the transfer device 1020 has the same configuration as the connector section 119 provided the fixation device 100 according to a first embodiment such as being illustrated in FIG. 8, and also the connector unit 701 provided to the image formation apparatus 3000 main body has the same configuration as the connector unit 201 provided to the image formation apparatus 1000 main body according to a first embodiment such as being illustrated in FIG. 8.

The transfer device 1020 is configured to be attached to and detached from the image formation apparatus 3000 main body. The connector unit 701 provided to the image formation apparatus 300 main body is arranged at a position facing the connector section 1119 of the transfer device 1020 in the image formation apparatus 3000 main body, a left positioning hole 751 is arranged at a position facing a left positioning post 1115 of the transfer device 1020 in the image formation apparatus 3000 main body, and a right positioning hole 752 is arranged at a position facing a right positioning post 1116 of the transfer device 1020 in the image formation apparatus 3000 main body.

The shape and the positional relationship of the left positioning post 1115 with respect to the connector section 1119 provided to the transfer device are the same as the shape and the positional relationship of the left positioning post 115 with respect to the connector section 119 provided to the fixation device such as being illustrated in FIG. 8, and the shape and the positional relationship of the left positioning hole 751 with respect to the connector unit 701 provided to the image formation apparatus 3000 main body are the same as the shape and the positional relationship of the left positioning hole 251 with respect to the connector unit 201 provided to the image formation apparatus 1000 main body such as being illustrated in FIG. 8.

Accordingly, the movements of the components in the course of moving the transfer device 1020 is moved from a detached position (see FIG. 29A) away from a mount position (see FIG. 29B) to the mount position in order to mount the transfer device 1020 onto the image formation apparatus 3000 main body are same as in the movements of the components illustrated in FIGS. 17 to 23 with replacing the connector section 119 of the fixation device with the connector section 1119 of the transfer device having the same configuration as the connector section 119 and replacing the connector unit 201 of the image formation apparatus 1000 main body with the connector unit 701 of the image formation apparatus 3000 main body having the same configuration as the connector unit 201.

Therefore, in the course of moving the transfer device 1020 from the detached position illustrated in FIG. 29A to the mount position illustrated in FIG. 29B, the connector 711 provided to the main body serving as a first connector and the connector 1113 provided to the transfer device serving as a second connector are fitted to each other along with the guiding movement as in the operations according a first embodiment illustrated in FIGS. 17 to 23. Accordingly, a detailed explanation of the movements of the components according to a third embodiment in the course of moving the fixation device 1020 from the detached position illustrated in FIG. 29A to the mount position illustrated in FIG. 29B is omitted for avoiding redundancies.

As described above, in the image formation apparatus 3000 according to a third embodiment, the allowable range of misalignment of the transfer device 1020 to the image formation apparatus 3000 main body at the time upon mounting the transfer device 1029 to the image formation apparatus 3000 main body can be expanded in the same manner as in the image formation apparatus 1000 according to a first embodiment.

Also in a third embodiment, external stress is not affected to the connector 711 of the main body and the connector 1113 of the transfer device upon fitting the connector 711 to the connector 1113, the reliability of the electrical connection between the connectors can be improved. Further, in a third embodiment, the floating unit is configured to be slidably movable with respect to the image formation apparatus 3000 main body, and this allows misalignment of the connector 711 and the connector 1113.

Fourth Embodiment

Figure 30A:
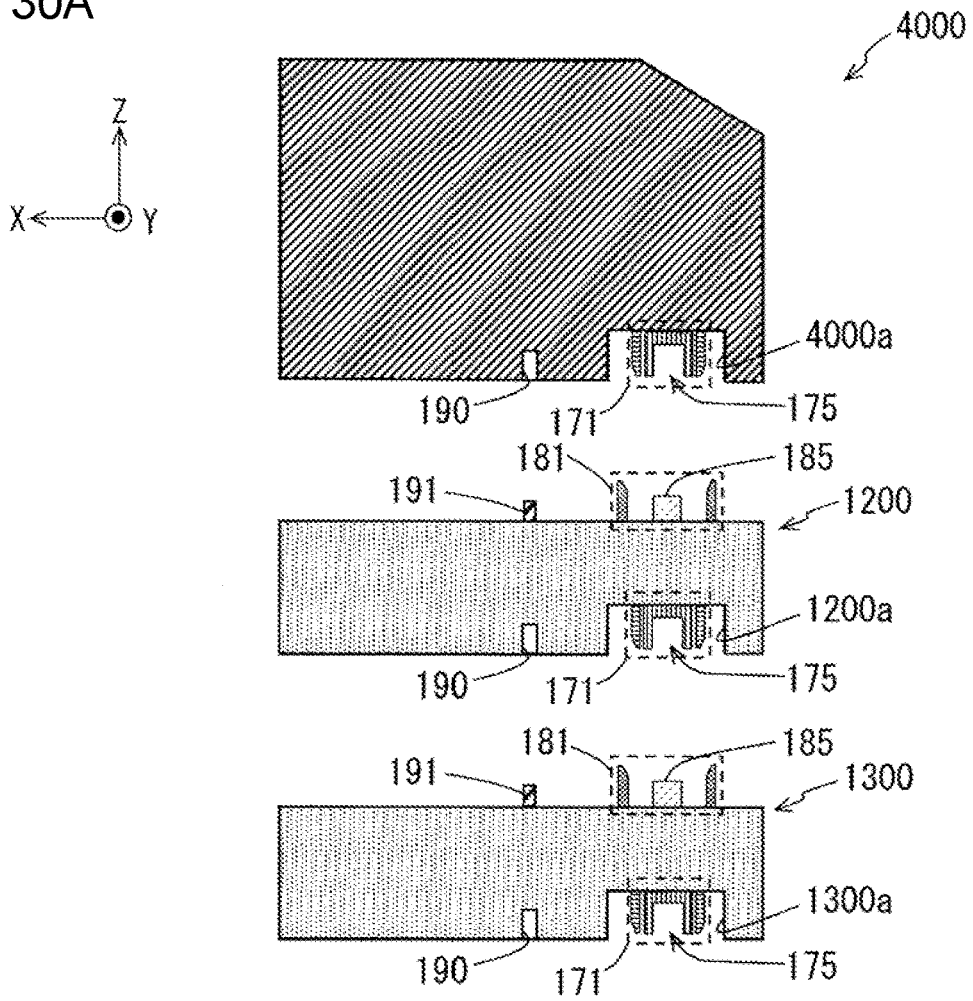
Figure 30B:
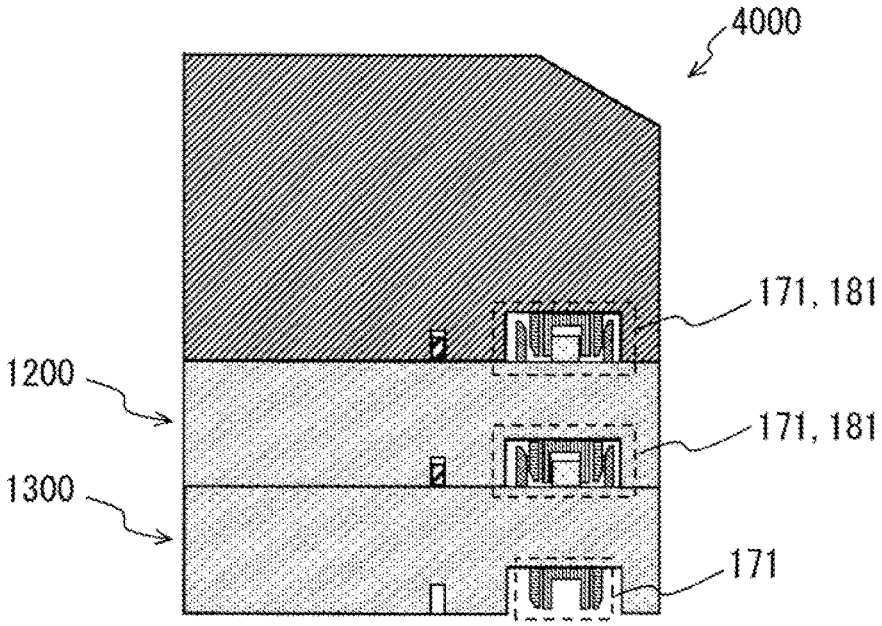

FIGS. 30A and 30B are diagrams illustrating a main configuration of an image formation apparatus 4000 according to a fourth embodiment. FIG. 30A illustrates a state in which a first option tray 1200 and a second option tray 1300 serving as detachable units are removed downwardly from a main body of the image formation apparatus 4000, and FIG. 30B illustrates a state in which the first option tray 1200 and the second option tray 1300 are mounted onto the image formation apparatus 4000 main body.

A main difference between the image formation apparatus 4000 according to a fourth embodiment and the image formation apparatus 1000 according to a first embodiment such as being illustrated in FIG. 8 is that a pair of an insertion connector section 171 and a reception connector section 181 are provided to the image formation apparatus 4000 main body and the first option tray 1200 detachable from the image formation apparatus 4000 main body, respectively and a pair of an insertion connector section 171 and a reception connector section 181 are provided to the first option tray 1200 and the second option tray 1300 that is detachable from the first option tray 1200, respectively. Accordingly, parts of the image formation apparatus 4000 according to a third embodiment that are in common with the image formation apparatus 1000 according to a first embodiment are omitted from the following description for avoiding redundancies by designating with the same references or by omitting illustration of the parts in the figures, and the differences will be described with emphasis.

As illustrated in FIGS. 30A and 30B, in the image formation apparatus 4000 according to a fourth embodiment, the insertion connector sections 171 corresponding to the connector section 119 provide to the fixation device 100 according to a first embodiment such as being illustrated in FIG. 8 are provided in an accommodation recess 4000*a* formed in a bottom portion of the image formation apparatus 4000 main body, in an accommodation recess 1200*a* formed in a bottom portion of the first option tray 1200, and in an accommodation recess 1300*a* formed in a bottom portion of the second option tray 1300, respectively, and the connector sections 181 corresponding to the connector unit 201 provided to the image formation apparatus 1000 main body according to a first embodiment such as being illustrated in FIG. 8 are provided to the upper surfaces of the first option tray 1200 and the second option tray 1300 respectively.

When the first option tray 1200 is opposed to the second option tray 1300 to be attached to the second option tray 1300, the reception connector section 181 is located at a position, in the second option tray 1300, opposed to the insertion connector section 171 of the first option tray 1200, and a positioning post 191 is located at a position, in the second option tray 1300, opposed to a positioning hole 190 of the first option tray 1200.

Further, when the image formation apparatus 4000 main body is opposed to the first option tray 1200 to be attached to the first option tray 1200, the reception connector section 181 is located at a position, in the first option tray 1200, opposed to the insertion connector section 171 of the image formation apparatus 4000 main body and the positioning post 191 is located at a position, in the first option tray 1200, opposed to the positioning hole 190 of the image formation apparatus 4000 main body.

The distance from the positioning hole 190 to the insertion connector section 171 according to a fourth embodiment is equivalent to the distance from the left positioning post 115 to the connector section 119 of the fixation device according to a first embodiment such as being illustrated in FIG. 8, and the distance from the positioning post 191 to the reception connector section 181 according to a fourth embodiment is equivalent to the distance from the left positioning hole 251 to the connector unit 201 of the image formation apparatus main body according to a first embodiment such as being illustrated in FIG. 8.

Accordingly, with this configuration, movements of the components in the course of moving from the detached position (see FIG. 30A) away from the mount position (see FIG. 30B) in order to mount the first option tray 1200 to the second option tray 1300 and in order to mount the image formation apparatus 4000 main body to the first option tray 1200 are same as in the movements of the components illustrated in FIGS. 17 to 23 with replacing the connector section 119 of the fixation device according to a first embodiment illustrated in FIG. 8 with the insertion connector section 171 according to a fourth embodiment having the same configuration as that of the connector section 119 and replacing the connector unit 201 of the image formation apparatus main body according to a first embodiment illustrated in FIG. 8 with the reception connector section 181 according to a fourth embodiment having the same configuration as that of the connector unit 201.

Accordingly, in the course of moving from the detached position to the mount position for the mounting operation, the connector 185 of the reception connector section 181 serving as a first connector and the connector 175 of the insertion connector section 171 serving as a second connector are fitted to each other along with the guiding movement as in the operations illustrated in FIGS. 17 to 23. Therefore, the detailed description thereof is omitted for avoiding redundancies.

As described above, according to the image formation apparatus 4000 according to a fourth embodiment, the allowable range of misalignment of the first option tray 1200 with respect to the second option tray 1300 and the allowable range of misalignment of the image formation apparatus 4000 main body with respect to the first option tray 1200 upon mounting can be expanded, as in the image formation apparatus 1000 according to a first embodiment.

In addition, in a fourth embodiment, external stress is not applied to the connectors upon fitting the connectors, the reliability of the electrical connection between the connectors can be improved. Further, the floating unit of the reception connector section 181 is configured to be slidably movable, misalignment of the connector 175 and the connector 185 can be allowed.

In one or more embodiments described above, the case has been described in which the image formation apparatus is a color printer, but the disclosure is not limited thereto. For example, the disclosure can be employed in an image formation apparatus such as a copier, a facsimile machine, and a multifunction peripheral (MFP). Also, the disclosure may be employed to a monochrome printer.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a detachable unit that is attachable to and detachable from a main body of the image formation apparatus;

a movable guide member holding a first connector and movably provided to one of the detachable unit and the main body of the image formation apparatus;

a second connector provided to the other of the detachable unit and the main body of the image formation apparatus; and an engagement portion provided around the second connector, wherein upon mounting the detachable unit to the main body of the image formation apparatus, the engagement portion contacts the movable guide member to move the movable guide member with respect to the one of the detachable unit and the main body of the image formation apparatus so as to position the first connector held by the movable guide member to a fittable range where the first connector and the second connector can be fitted to each other, and upon fitting the first connector and the second connector to each other, the first connector contacts the second connector to move the movable guide member holding the first connector with respect to the one of the detachable unit and the main body of the image formation apparatus so as to align the first connector to the second connector.

2. The image formation apparatus according to claim 1, wherein upon mounting the detachable unit to the main body of the image formation apparatus, the first connector and the second connector start to fit to each other after the engagement portion contacts the movable guide member.

3. The image formation apparatus according to claim 2, wherein the movable guide member includes a connector accommodation portion that surrounds the first connector and is configured to come in contact with the engagement portion, and the connector accommodation portion is formed, at a tip of the connector accommodation portion, with a first taper portion facing an inside of the connector accommodation portion, and upon mounting the detachable unit to the main body of the image formation apparatus, the engagement portion contacts the first taper portion provided at the movable guide member to move the movable guide member to position the first connector held by the movable guide member to the fittable range where the first connector and the second connector can be fitted to each other.

4. The image formation apparatus according to claim 3, wherein the first connector is formed, at an outer circumference of a tip of the first connector that faces the second connector, with a second taper portion that faces an outside of the first connector and that is configured, upon fitting the first connector and the second connector to each other, to come in contact with the second connector to align the first connector with respect to the second connector.

5. The image formation apparatus according to claim 2, wherein the engagement portion is formed to surround the second connector and is formed, at a tip of the engagement portion, with a third taper portion that faces an outside of the engagement portion and is configured to come in contact with the movable guide member, and upon mounting the detachable unit to the main body of the image formation apparatus, the third taper portion provided at the engagement portion contacts the movable guide member to move the movable guide member to position the first connector held by the movable guide member to the fittable range where the first connector and the second connector can be fitted to each other.

6. The image formation apparatus according to claim 5, wherein the second connector is formed, at an inner circumference of a tip of the second connector that faces the first connector, with a fourth taper portion that faces an inside of the second connector and that is configured, upon fitting the first connector and the second connector to each other, to come in contact with the first connector to align the first connector with respect to the second connector.

7. The image formation apparatus according to claim 1, wherein the movable guide member is provided to the detachable unit, and the second connector is provided to the main body of the image formation apparatus.

8. The image formation apparatus according to claim 1, wherein the detachable unit comprises a transfer device that is attachable to and detachable from the main body the image formation apparatus.

9. The image formation apparatus according to claim 1, wherein the detachable unit comprises an optional tray that is attachable to and detachable from the main body the image formation apparatus.

10. The image formation apparatus according to claim 1, wherein the movable guide member and the engagement portion are separated from each other in a state where the detachable unit is attached to the main body of the image formation apparatus.

11. An image formation apparatus comprising:

a fixation unit that is attachable to and detachable from a main body of the image formation apparatus;

a movable guide member holding a first connector and movably provided to the main body of the image formation apparatus;

a second connector provided to the fixation unit; and an engagement portion provided around the second connector, wherein upon mounting the fixation unit to the main body of the image formation apparatus, the engagement portion contacts the movable guide member to move the movable guide member with respect to the main body of the image formation apparatus to position the first connector held by the movable guide member to a fittable range where the first connector and the second connector can be fitted to each other, and upon fitting the first connector and the second connector to each other, the first connector contacts the second connector to move the movable guide member holding the first connector with respect to the main body of the image formation apparatus so as to align the first connector to the second connector.

12. The image formation apparatus according to claim 11, wherein the movable guide member and the engagement portion are separated from each other in a state where the fixation unit is attached to the main body of the image formation apparatus.

* * * * *